US008973398B2

(12) United States Patent
Coyle

(10) Patent No.: US 8,973,398 B2
(45) Date of Patent: Mar. 10, 2015

(54) APPARATUS AND METHOD FOR REGASIFICATION OF LIQUEFIED NATURAL GAS

(75) Inventor: David A. Coyle, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 1508 days.

(21) Appl. No.: 12/038,322

(22) Filed: Feb. 27, 2008

(65) Prior Publication Data

US 2009/0211263 A1 Aug. 27, 2009

(51) Int. Cl.

*F25J 1/00* (2006.01)
*F25J 3/00* (2006.01)
*F17C 9/02* (2006.01)

(52) U.S. Cl.

CPC ..... *F17C 9/02* (2013.01); *F17C 2203/0678* (2013.01); *F17C 2265/05* (2013.01); *F17C 2201/0104* (2013.01); *F17C 2201/0128* (2013.01); *F17C 2201/052* (2013.01); *F17C 2203/0333* (2013.01); *F17C 2203/0341* (2013.01); *F17C 2203/0391* (2013.01); *F17C 2203/0604* (2013.01); *F17C 2203/0629* (2013.01); *F17C 2203/0639* (2013.01); *F17C 2203/0648* (2013.01); *F17C 2205/0367* (2013.01); *F17C 2221/014* (2013.01); *F17C 2221/033* (2013.01); *F17C 2221/035* (2013.01); *F17C 2223/0161* (2013.01); *F17C 2223/033* (2013.01); *F17C 2227/0135* (2013.01); *F17C 2227/0157* (2013.01); *F17C 2227/0178* (2013.01); *F17C 2227/0309* (2013.01); *F17C 2227/0313* (2013.01); *F17C 2227/0318* (2013.01); *F17C 2227/0327* (2013.01); *F17C 2227/0332* (2013.01); *F17C 2227/0393* (2013.01); *F17C 2227/0397* (2013.01); *F17C 2260/032* (2013.01); *F17C 2265/015* (2013.01); *F17C 2265/034* (2013.01); *F17C 2265/07* (2013.01); *F17C 2270/0105* (2013.01); *F17C 2270/0113* (2013.01); *F17C 2270/0123* (2013.01); *F17C 2270/0136* (2013.01); *F17C 2270/0581* (2013.01)

USPC ..... 62/611; 62/618; 62/50.2

(58) Field of Classification Search

USPC ..... 62/620, 621, 50.2, 611, 612, 614, 623
See application file for complete search history.

(56) References Cited

U.S. PATENT DOCUMENTS

| | | | |
|---|---|---|---|
| 2,815,650 | A | 12/1957 | McIntire et al. |
| 3,282,060 | A | 11/1966 | Hays |
| 3,331,214 | A | 7/1967 | Proctor et al. |
| 3,420,068 | A | 1/1969 | Petit et al. |
| 3,570,828 | A | 3/1971 | Cowan |
| 3,770,048 | A | 11/1973 | Linhardt et al. |
| 3,837,172 | A | 9/1974 | Markbreiter |
| 4,036,028 | A | 7/1977 | Mandrin |
| 4,270,940 | A | 6/1981 | Rowles et al. |

(Continued)

OTHER PUBLICATIONS

Crawford, D.B. and Eschenbrenner, G.P. "Heat Transfer Equipment for LNG," Chemical Engineering Progress, Sep. 1972.

(Continued)

*Primary Examiner* — Frantz Jules
*Assistant Examiner* — Webeshet Mengesha
(74) *Attorney, Agent, or Firm* — Gary M. Machetta

(57) ABSTRACT

A method for vaporizing a liquefied natural gas (LNG) stream and recovering heavier hydrocarbons from the LNG utilizing a heat transfer fluid is disclosed.

29 Claims, 36 Drawing Sheets

(56) References Cited

U.S. PATENT DOCUMENTS

| | | | | |
|---|---|---|---|---|
| 4,519,213 | A | 5/1985 | Brigham et al. | |
| 4,753,667 | A | 6/1988 | O'Connell et al. | |
| 5,114,451 | A | 5/1992 | Rambo et al. | |
| 5,251,452 | A | 10/1993 | Wieder | |
| 5,685,170 | A | 11/1997 | Sorensen | |
| 5,950,453 | A | 9/1999 | Bowen et al. | |
| 5,953,935 | A | 9/1999 | Sorensen | |
| 5,956,971 | A | 9/1999 | Cole et al. | |
| 5,992,175 | A | 11/1999 | Yao et al. | |
| 6,182,469 | B1 | 2/2001 | Campbell et al. | |
| 6,237,364 | B1 | 5/2001 | Stone | |
| 6,510,706 | B2 | 1/2003 | Stone | |
| 6,564,579 | B1 * | 5/2003 | McCartney | 62/620 |
| 6,578,362 | B1 * | 6/2003 | Coffinberry | 60/782 |
| 6,598,408 | B1 | 7/2003 | Nierenberg | |
| 6,604,380 | B1 | 8/2003 | Reddick et al. | |
| 6,622,492 | B1 | 9/2003 | Eyermann | |
| 6,644,041 | B1 | 11/2003 | Eyermann | |
| 6,941,771 | B2 | 9/2005 | Reddick et al. | |
| 6,964,181 | B1 | 11/2005 | Milios et al. | |
| 7,069,743 | B2 * | 7/2006 | Prim | 62/620 |
| 7,155,917 | B2 | 1/2007 | Baudat | |
| 2005/0126220 | A1 * | 6/2005 | Ward | 62/625 |
| 2006/0032239 | A1 * | 2/2006 | Sudduth et al. | 62/48.2 |
| 2006/0130521 | A1 | 6/2006 | Patel | |
| 2007/0062216 | A1 * | 3/2007 | Mak et al. | 62/620 |
| 2007/0125122 | A1 * | 6/2007 | Mak et al. | 62/620 |
| 2007/0149838 | A1 * | 6/2007 | Chretien | 585/650 |
| 2007/0186564 | A1 * | 8/2007 | Hubbard et al. | 62/50.2 |
| 2007/0193303 | A1 | 8/2007 | Hawrysz et al. | |
| 2008/0190106 | A1 * | 8/2008 | Mak | 60/531 |
| 2008/0264100 | A1 * | 10/2008 | Mak et al. | 62/618 |
| 2009/0221864 | A1 * | 9/2009 | Mak | 585/803 |
| 2009/0282836 | A1 * | 11/2009 | Mak | 60/783 |

OTHER PUBLICATIONS

Durr, C.A. and Crawford, D.B. "LNG Terminal Design," Hydrocarbon Processing, Dec. 1973.

Crawford, D.B. and Bergman, R.A "Innovations Will Mark LNG Receiving Terminal," Oil & Gas Journal, Aug. 5, 1974.

Crawford, D.B. and Bergman, M.E. "Columbia—Consolidated LNG Receiving Terminal, Cove Point, Maryland," LNG IV, Algeria, 1974.

Shah, J.T. and de la Vega, F. "Advisory System for LNG Storage Facilities Use KBS Technology," Expert Systems Applications, Oct. 1991.

Colllins, C. "Developments in LNG Trade & Technology," GPA European Chapter LNG Meeting, London, Nov. 28, 1991.

Tarlowski, J., Collins, C., and de la Vega, F.F. "Developments in the Design of LNG Import Terminals," Gastech, 1993.

Coyle, D.A., Durr, C.A., de la Vega, F. and Hill, D.K. "LNG Plant Design in the 1990's" 74th Annual GPA Convention, San Antonio, Mar. 13-15, 1995.

Collins, C. and Durr, C.A. "Cost Reduction for LNG Export & Import Facilities," Prepared for the SMI Conference Understanding and Improving the Economics of Liquefied Natural Gas, London, Jan. 25-26, 1999.

Mayer, M., Robertson, A. Sheffield, Courtay R., and Harr R. "Safe Production of LNG on an FPSO," GasTech 200.

Patel, D., Tarlowski J., and Collins C. "Developments in LNG Storage," SMI Conference, Feb. 2000.

Sheffield, J.A. and Mayer M. "The Challenges of Floating LNG Facilities," GPA Spring Meeting, Norwich, 2001.

Tarlowski J., Sheffield J., Durr C., Coyle D. an Patel H. "LNG Import Terminals—Recent Developments," GPA, Rome 2002.

Durr C., Coyle C., and Patel H. "LNG Import Terminals," GPA 2002.

Durr C., Coyle D., Patel H. and Cho, J.H. "Advanced Design of LNG Import Terminals," AIChE National Spring Meeting, Apr. 1, 2003.

Songhurst B. "LNG Terminals—Now is the Time to Improve the Thermal Integration," LNG Journal, Jul. 2003.

Cho J.H., Patel H., Coyle D.A., and Durr C.A., "A Case Study for Integrated LNG-to-Power: Technical Comparison of Available Cost Reduction Methods," AIChE Spring National Meeting, Apr. 25-29, 2004.

Songhurst B. "LNG Update," GPA Europe Conference, Dublin, May 19-21, 2004.

Huang S., Coyle D., Cho J., and Durr C. "Select the Optimum Extraction Method for LNG Regasification," Hydrocarbon Processing, Jul. 2004.

Townsend B. and Khaligh B. "Opportunities for Elegant Power Systems Design in LNG," SMi LNG Conference, London, Feb. 21-22, 2005.

Durr C., Caswell C., Echterhoff L., Hill D.K., and Coyle D.A. "LNG Technology is on the Move: The Only Thing Constant is Change . . . " GasTech, Bilbao, Spain, Mar. 2005.

Coyle D.A. and Patel V. "Processes and Pump Services in the LNG Industry," 22nd International Pump Users Symposium, Houston, Feb. 28-Mar. 3, 2005.

Huang S., Kotzot H., de la Vega F., and Durr C. "Selecting the Optimal Scheme for N2 Injection in an LNG Terminal, " GPA 84th Annual Convention, San Antonio, Mar. 13-16, 2005.

Cho J.H., Kotzot H., Patel H., and Durr C. "Low Emissions with Advanced Vaporization Processes," AIChE LNG Conference, Vancouver, Sep. 2005.

Coyle D., Durr C. and Shah P. "LNG: A Proven Stranded Gas Monetization Option," SPE Annual Technical Conference and Exhibition, Denver, Oct. 5-8, 2003.

Cho J.H., Ebbem D., Kotzot H., and Durr C. "Marrying LNG and Power Generation," Energy Markets, Oct./Nov. 2005.

Cho J.H., Kotzot, H., de la Vega F., and Durr C. "LNG Vaporization Needs Low-Cost and Environmentally-Friendly Solutions," LNG Joumal, Mar. 2006.

Cho J.H., Femat R., Kotzot H., and Durr C. "Optimization of Ambient Air Vaporization Processes," AIChE Spring Meeting, Orlando, Apr. 23-27, 2006.

Cho J.H., Kotzot H., de la Vega F., and Durr C. "Cost Effective Air Heater Vaporization with the Three-Shell Vaporizer," LNG Journal, Nov. 2006.

Ross, F.P, Walther, S.T., "Advanced technologies provide improved economics for liquefied natural gas facilities," Hydrocarbon Processing, Jan. 2008.

* cited by examiner

APPARATUS AND METHOD FOR REGASIFICATION OF LIQUEFIED NATURAL GAS

BACKGROUND

1. Field

The present embodiments generally relate to liquefied hydrocarbon fluids, and to methods and apparatus for processing such fluids. Natural gas is an important energy source which is obtained from subterranean wells; however, it is sometimes impractical or impossible to transport natural gas by pipeline from the wells where it is produced to the sites where it is needed, due to excessive distance or geographical barriers such as oceans. In such situations, liquefaction of natural gas offers an alternative way of transporting it.

2. Description of the Related Art

Natural gas can be converted to liquefied natural gas (LNG) by cooling it to about −161° C., depending on its exact composition, which reduces its volume to about 1/600 of its original value. This reduction in volume can make transportation more economical. The liquefied natural gas (LNG) can be transferred to a cryogenic storage tank located on an ocean-going ship. Once the ship arrives at its destination, the LNG can be offloaded to a regasification facility, in which it is converted back into gas by heating it. Once it has been regasified, the natural gas can be transported by pipeline or other means to a location where it can be used as a fuel or a raw material for manufacturing other chemicals.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
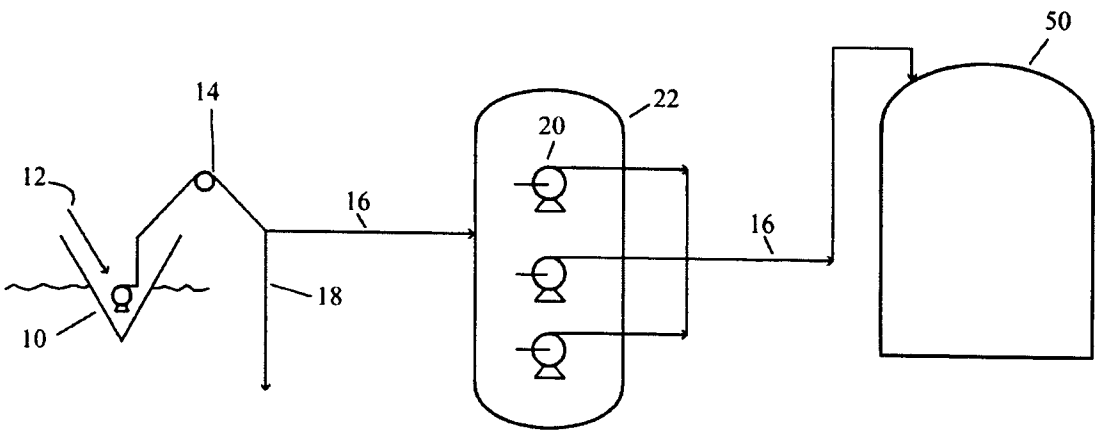
FIG. 1 depicts an illustrative schematic of an LNG unloading system.

A detailed description will now be provided. Each of the appended claims defines a separate invention, which for infringement purposes is recognized as including equivalents to the various elements or limitations specified in the claims.

Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

One embodiment of the present invention is a method for vaporizing a liquefied natural gas stream (LNG) and recovering liquefied petroleum gas (LPG) from the LNG. The method involves fractionating a first stream of liquefied natural gas in a LPG recovery column to produce a first lean natural gas stream and LPG and recovering at least a portion of the LPG from the LPG recovery column. The LPG can comprise ethane and higher hydrocarbons. Heat duty is provided to the LPG recovery column with a first heat transfer fluid stream by heat exchange in a reboiler, wherein the heat transfer fluid exits the reboiler as a second heat transfer fluid stream, the second heat transfer fluid stream having a temperature less than ambient temperature. At least a portion of the second heat transfer fluid stream that exits the reboiler is then utilized for a refrigerant use. The heat transfer fluid can be circulated by a heat transfer fluid circulation pump. An auxiliary heater capable of increasing the temperature of one or more of the heat transfer fluid streams can be included. The first heat transfer fluid stream can provide heat duty to the LPG recovery column in one or more of an inter-reboiler and a bottom reboiler. In some embodiments the second heat transfer fluid stream exiting the LPG recovery column has a temperature less than 25° C.

A first air stream can be cooled by heat exchange with at least a portion of the second heat transfer fluid stream in one or more heat exchangers to produce a first chilled air stream and a third heat transfer fluid stream. The first chilled air stream can be an inlet air stream to a fired turbine. The fired turbine can produce an exhaust stream and at least a portion of the third heat transfer fluid stream can be heated by heat exchange with the exhaust stream of the turbine in a heat exchanger. The fired turbine can drive a generator that produces electrical energy.

The first stream of liquefied natural gas can be pumped from a LNG storage tank to the LPG recovery column, for example with one or more high head submersible pumps located within the LNG storage tank. Natural gas vapors from the LNG storage tank can be collected and compressed to form a natural gas vapor stream. The natural gas vapor inlet stream can be injected into the LPG recovery column and can provide heat duty to the LPG recovery column. Injecting the natural gas vapor inlet stream into the LPG recovery column can eliminate the need for a recondenser.

The method can further include injecting the natural gas vapor stream from the LNG storage tank as an input to a recondenser and providing at least a portion of the first stream of liquefied natural gas as an input to the recondenser, wherein the natural gas vapor stream is recondensed into the first stream of liquefied natural gas. The first stream of liquefied natural gas can be heated in a first heat exchanger to produce an at least partially vaporized natural gas stream prior to the LPG recovery column. The first stream of liquefied natural gas can be heated in the first heat exchanger by heat transfer with the first lean natural gas stream from the LPG recovery column.

The first lean natural gas stream can be heated by heat exchange with a heat transfer fluid stream in a vaporizer system to produce a vaporized natural gas stream suitable for delivery to a pipeline or for commercial use. At least a portion of the heat transfer fluid stream exiting the vaporizer system can be the first heat transfer fluid stream. The vaporizer system can comprise one or more heat exchangers and can include vaporizing at least a portion of the first lean natural gas stream by heat exchange in a second heat exchanger with a third lean natural gas stream to produce a second lean natural gas stream; heating the second lean natural gas stream in a third heat exchanger by heat exchange with a first portion of a fourth heat transfer fluid stream to produce a third lean natural gas stream; cooling the third lean natural gas stream in the second heat exchanger by heat exchange with the first lean natural gas stream to produce a fourth lean natural gas stream; and heating the fourth lean natural gas stream in a fourth heat exchanger by heat exchange with a second portion of a fourth heat transfer fluid stream to produce a fifth lean natural gas stream suitable for delivery to a pipeline or for commercial use.

The second, third and fourth heat exchangers can be shell and tube type heat exchangers. The second heat exchanger can have the first high-pressure liquefied natural gas stream entering the tube side and the third compressed natural gas stream entering the shell side. The third heat exchanger can have the second compressed natural gas stream entering the tube side and a portion of a fourth heat transfer fluid stream entering the shell side. The fourth heat exchanger can have the fourth compressed natural gas stream entering the tube side and a portion of a fourth heat transfer fluid stream entering the shell side. The fourth heat transfer fluid stream can be heated by heat exchange with the exhaust stream of a fired turbine in a heat exchanger. The fourth heat transfer fluid stream can also be heated by an auxiliary heater.

In one alternate embodiment the method can further include compressing the first lean natural gas stream to produce a first compressed gas stream; condensing the first compressed gas stream to a liquid state by heat exchange with the first stream of liquefied natural gas in the first heat exchanger to produce a second stream of liquefied natural gas; pumping the second stream of liquefied natural gas to produce a first high-pressure liquefied natural gas stream; and vaporizing the first high-pressure liquefied natural gas stream by heat exchange in one or more heat exchangers with a first portion of a first heat transfer fluid stream to produce a natural gas stream suitable for delivery to a pipeline or for commercial use.

In one alternate embodiment the method can further include compressing the first lean natural gas stream to produce a first compressed gas stream; and vaporizing the first high-pressure liquefied natural gas stream by heat exchange in one or more heat exchangers with a first portion of a first heat transfer fluid stream to produce a natural gas stream suitable for delivery to a pipeline or for commercial use.

In one alternate embodiment the method can further include condensing the first lean natural gas stream to a liquid state by heat exchange with the first stream of liquefied natural gas in the first heat exchanger to produce a second stream of liquefied natural gas; pumping the second stream of liquefied natural gas to produce a first high-pressure liquefied natural gas stream; and vaporizing the first high-pressure liquefied natural gas stream by heat exchange in one or more heat exchangers with a first portion of a first heat transfer fluid stream to produce a natural gas stream suitable for delivery to a pipeline or for commercial use.

Liquefied natural gas (LNG) can be transported in specially built ships capable of storing the LNG in a refrigerated liquid state. The LNG can be kept cooled and in a liquid state while on the ship by evaporating a fraction of the LNG, which is referred to as boil-off. The ship can use the boil-off as fuel for its own engines, or the gas can be re-liquefied. The LNG receiving terminal or "regasification" facility can receive liquefied natural gas from a ship, store the LNG in storage tanks, vaporize the LNG, and then deliver the vaporized natural gas into a distribution pipeline. The receiving terminal may also be designed to deliver a specified gas rate into a distribution pipeline and to maintain a reserve capacity of LNG.

LNG Shipping

Protection of the LNG tanker during navigation, berthing, unberthing and while docked and unloading is a major design consideration. Transfer of LNG is a relatively high risk aspect of the operation, and special measures should be taken by the terminal designers to protect the general public as well as the employees of the terminal. Such measures include emergency shutdown systems, emergency release coupling, spill containment, and anti-pressure surge protection of piping. LNG terminal layout and site selection are strongly influenced by the size and draft of the ship to be served and the size and number of the storage tanks required.

LNG Ship Unloading

Figure 2:
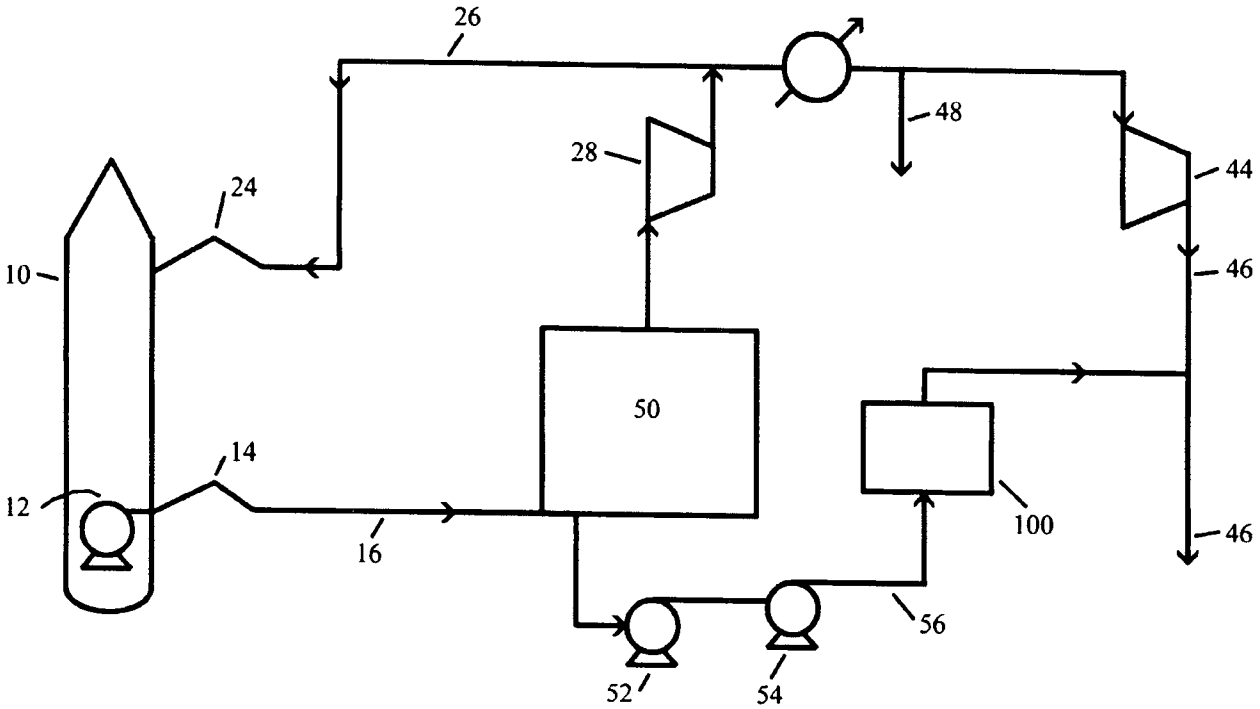
FIG. 2 depicts an illustrative schematic of an LNG receiving terminal.

When the ship reaches its destination, the LNG can be offloaded at a receiving/unloading terminal. The facilities near the receiving/unloading terminal can include storage tanks, regasification facilities, and equipment for transportation of natural gas to consumers. Referring to FIGS. 1 and 2, following ship 10 berthing and cool-down of the unloading arms 14 and the unloading lines 16, LNG can be transferred to (onshore or offshore) LNG tanks 50 by the ship pumps 12. The LNG flows from the ship through the unloading arms 14 and the unloading lines 16 into the storage tanks 50. Additional unloading pumps 20 can be used in conjunction with a suction drum 22 for transport of the LNG. One typical configuration of loading lines can be two parallel pipelines, each 24-30 inches in diameter, or alternately a single 30-36 inch pipeline, with a 6-10 inch recirculation line.

The unloading arms 14 that connect the ship to the unloading lines 16 must be flexible enough to allow for the ship's movements and are similar to conventional unloading arms except the arm and the special swivel joints can be made of special materials to handle cryogenic temperatures. The uninsulated swivel joint is designed so that it cannot freeze in position due to icing. These arms are often made of stainless steel and can be self-supporting. The two main criteria used in selecting the number and size of the arms are the liquid velocity in the arm, and the compatibility with the ship's flange size. The velocity in the arms must be limited to reduce vibrational forces and any possible water-hammer type forces. Additionally, the size of the arms must be compatible with the flange size of the expected ships.

In some applications the arms 14 are balanced and hydraulically powered from a remote location; they can be balanced to move either with or without liquid in them. Since the arms 14 may not be able to be moved both ways, with and without liquid in them, without counter-weighing them again, it can be advantageous to design them to move only when empty. This requires that the arms be drained before unflanging them from the ship and may be accomplished in several ways, the liquid could be pressured out by nitrogen-gas injection at the apex of the arm. Thus, the liquid can be forced into the ship and/or shore piping 18 by nitrogen displacement. Alternately, the liquid can be drained into a separate holding drum and then vaporized via an atmospheric vaporizer, the vapor then typically fed into a vapor handling system. In another means, the arms may be pumped dry via a small low Net Positive Suction Head (NPSH) pump.

It is common to have one or more unloading arms 14 for LNG and one arm 24 for return vapor. One embodiment can have three unloading arms for LNG and one arm for return vapor. During ship unloading, some of the vapor generated in the storage tank can be returned to the ship's cargo tanks, via a vapor return line 26 and arm 24, in order to maintain a positive pressure in the ship. Vapor return blowers 28 may be used due to the low pressure difference between the storage tank and the ship. With a vapor return line any excess ship boil-off can be vented to the receiving terminal vapor handling system.

A major consideration in designing the unloading and vapor-return lines is to provide enough piping flexibility to handle the contraction and expansion associated with temperature cycles in the unloading line. Flexibility problems can be handled by installing expansion bellows or piping loops. Expansion bellows can be preferred because expansion loops require more piping, more pressure drop, and can increase the construction cost for the pier. Expansion bellows are typically more vulnerable to failure than piping, so where space is available for expansion loops piping can be preferred. Single-ply bellows can be used, and in some applications it may be desirable to use double-ply bellows with the outer ply capable of containing the LNG. In this service the annulus space should be monitored for leaking LNG to forewarn that the inner bellow has ruptured. Provisions can also be made to ensure that solids (ice) do not become trapped in the bellows and cause a bellow to rupture.

Insulation: Some of the basic types of insulation used for LNG terminal piping are mechanical types or vacuum jacketing. Within the mechanical types there are also the distinctions of pre-insulated vs. field-insulated; and polyurethane vs. cellular glass such as FOAMGLAS® from Pittsburgh Corning Corporation. Many LNG terminals use polyurethane due to its good thermal conductivity and because it is relatively economical. However, since polyurethane is less impervious to vapors than FOAMGLAS®, provisions must be made to ensure that a good vapor barrier is provided to protect the insulation from deterioration due to water ingress. It is also important to design the insulation system such that combustible gas does not leak from the piping into the insulation because this may present a hazard. FOAMGLAS® is advantageous in that it is impervious to water vapor; thus it is easier to protect against insulation deterioration due to water ingress. FOAMGLAS® also has a higher compressive strength than polyurethane, which can result in a more durable application.

Preinsulated piping offers advantages because it minimizes field labor and because production-line manufacturing can in some instances increase quality control. The major disadvantage of preinsulated pipe is the possibility of shipping and schedule delays. Preinsulated pipe is usually shipped to the terminal site with the ends left bare. The pipe can then be welded and the ends are then field insulated via preformed rigid insulation or the insulation can be field applied in the manner referred to as poured-in-place. In general it is preferred to use preformed rigid insulation for larger piping because there can be problems associated with large pours.

Vacuum-jacket piping may also be considered for LNG terminals. This type is constructed such that there are two piping walls; the inner wall that is constructed of a material to contain the LNG and an outer wall that may be constructed of carbon steel or other material. The annulus between the two piping walls can be filled with insulation, evacuated to form a vacuum or near vacuum conditions, and then sealed. The heat leakage from this system can be substantially less that of the typical mechanical types of insulation. Under special circumstances it may be worthwhile to design a piping system that has two structural barriers capable of containing the LNG. This may be accomplished in several ways, such as for example, the vacuum-jacket piping may be designed such that the outer pipe is also suitable for cryogenic temperatures. Alternatively, the piping may be installed within a cold box that is constructed to withstand the internal and external forces. For example, a concrete cold box could be installed; the cold box could be filled with bulk insulation, sealed and pressurized.

LNG Storage

A LNG receiving/unloading terminal can receive LNG that is pumped from the ship 10 through unloading arms 14 and transfer lines 16 into storage tanks 50. In some embodiments, in order to minimize cost, it can be useful to maximize the size of each LNG storage tank. Types of tanks similar to those used for storage at LNG liquefaction facilities can be used. Described below are a few types of storage tanks. Use of higher pressure storage tanks can eliminate use of blowers 28 for return vapor to LNG ships during unloading. Careful layout design can also reduce piping costs.

Single Containment Systems

Figure 3:
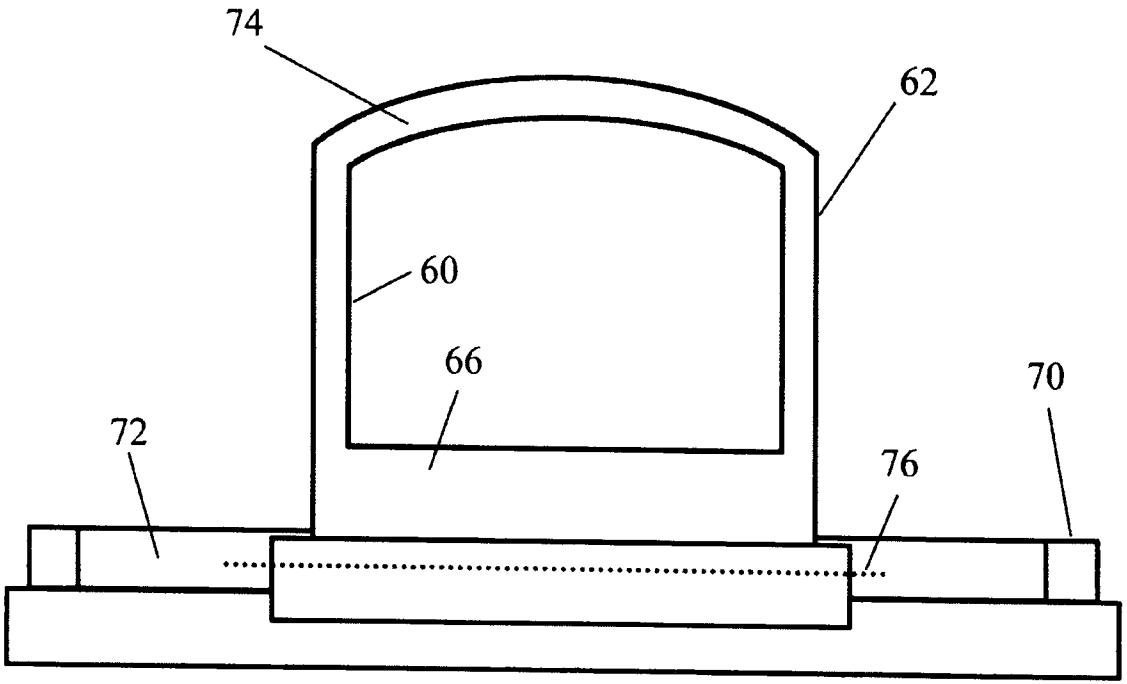
FIG. 3 depicts two illustrated examples of single containment LNG storage tanks.

Referring to FIG. 3, the inner wall or primary container 60 of the single containment tank can be constructed of a material, such as 9% nickel steel, which can contain the refrigerated liquid and can be self-supporting. This inner tank can be surrounded by an outer wall 62 which can be of a different material, such as carbon steel, that can hold insulation, such as perlite, in the annular space between the inner and outer walls 64. A carbon steel outer tank 62 is not capable of containing LNG, thus the only containment is that provided by the inner tank 60. The base can have insulation 66 and some embodiments can have a suspended deck roof 68 that can also be insulated. Single containment tanks are surrounded by a dike 70 or containment basin external to the tank, either of which provide secondary containment 72 in the event of failure or leakage of the LNG. Embodiments can have external insulation 74 an can have bottom heating 76. In some embodiments the tanks can be elevated above grade, such as utilizing an elevated concrete raft structure, which can provide additional room for spill containment and eliminate the need for bottom heating.

Double Containment Systems

Figure 4:
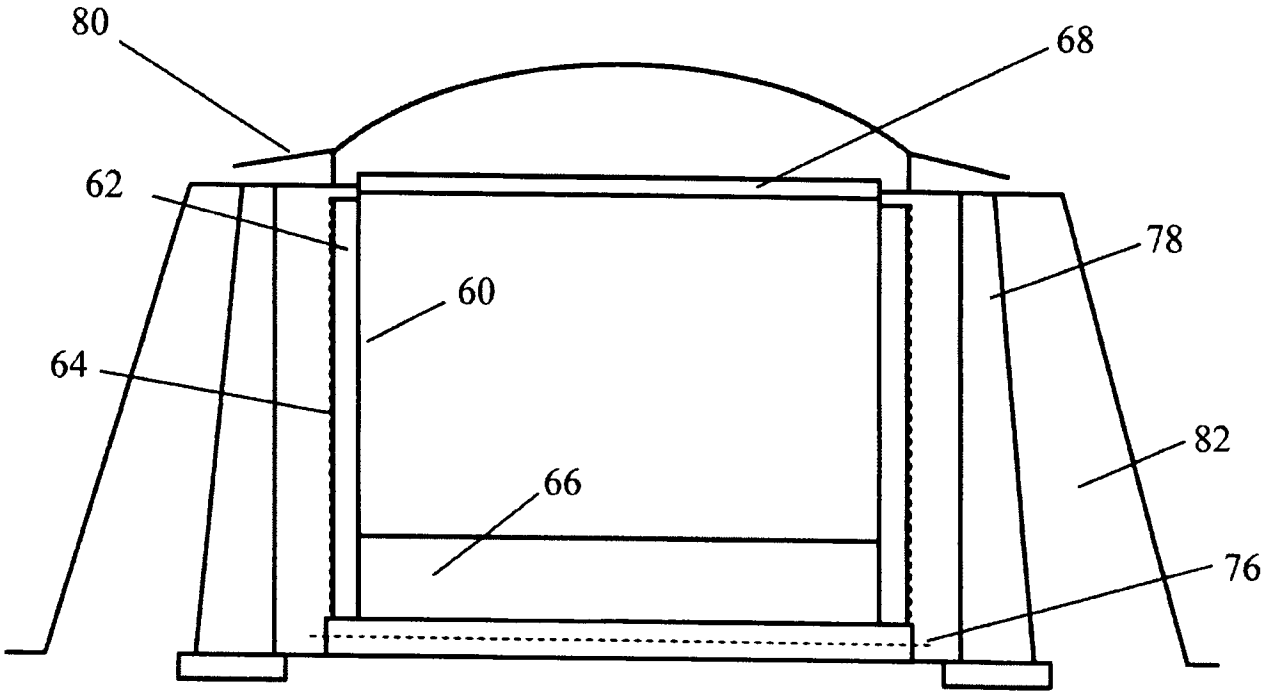
FIG. 4 depicts two illustrated examples of double containment LNG storage tanks.

Referring to FIG. 4, Double Containment systems include a secondary wall 78 that is capable of containing both liquid and vapor. The inner wall 60 can be constructed of a material, such as 9% nickel steel, which can contain the refrigerated liquid and can be self-supporting. The roof 68 over the inner tank can be carbon steel. Double containment tanks have an outer wall 78, such as a steel or concrete wall, capable of holding LNG. In Double Containment systems no dike is needed because the outer wall provides the secondary containment for the LNG. LNG vapors, however, may be released in the event of an inner tank leak in systems where there is no sealed roof to the outer wall. A roof 80 that is not sealed to the outer wall 78 can be provided and an earth embankment 82 can be placed exterior to the outer wall 78.

Full Containment Systems

Figure 5:
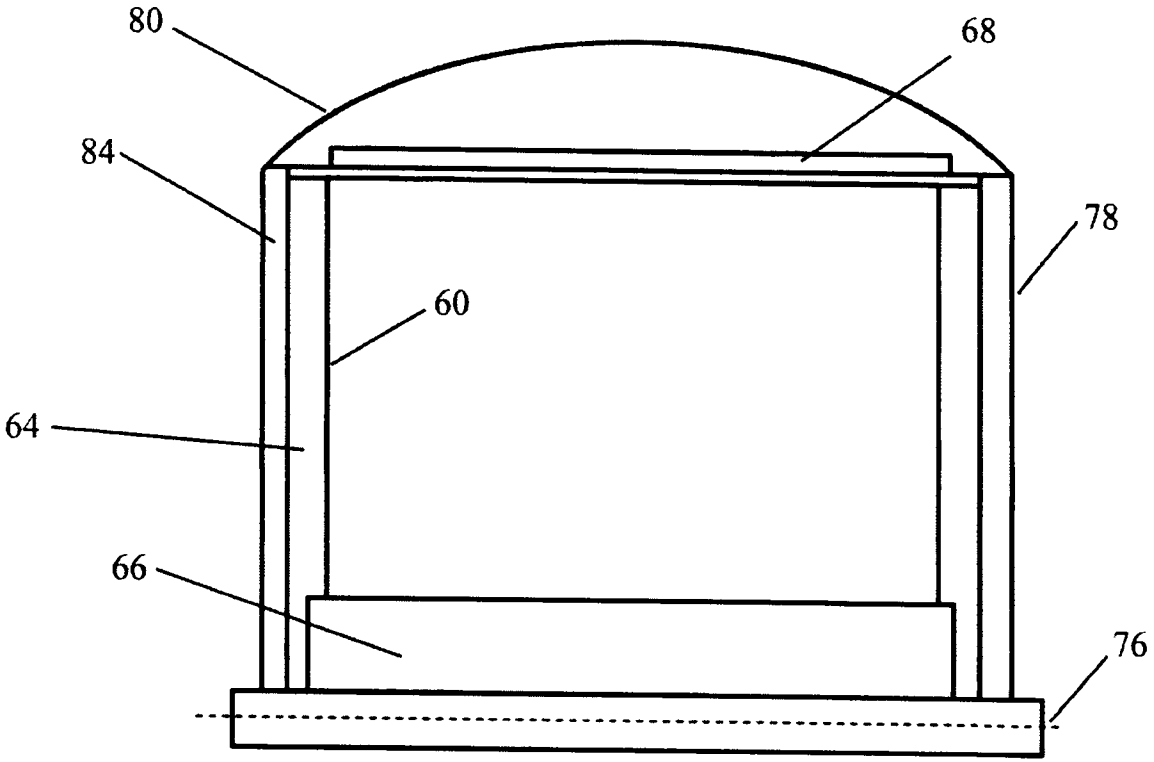
FIG. 5 depicts two illustrated examples of full containment LNG storage tanks.

Referring to FIG. 5, a Full Containment system includes a secondary wall 78 that is capable of containing both liquid and vapor that has roof 80 over the outer wall, such as a concrete or steel roof, making the outer tank capable of handling both LNG liquid and vapor. The inner wall 60 can be constructed of a material, such as 9% nickel steel, which can contain the refrigerated liquid and be self-supporting. The roof 68 over the inner tank 60 can be carbon steel. If the inner tank leaks, all liquids and vapors can still be contained within the outer wall 78 and roof 80. There can be insulation 84 on the inside of the secondary wall 78.

Membrane Systems

Figure 6:
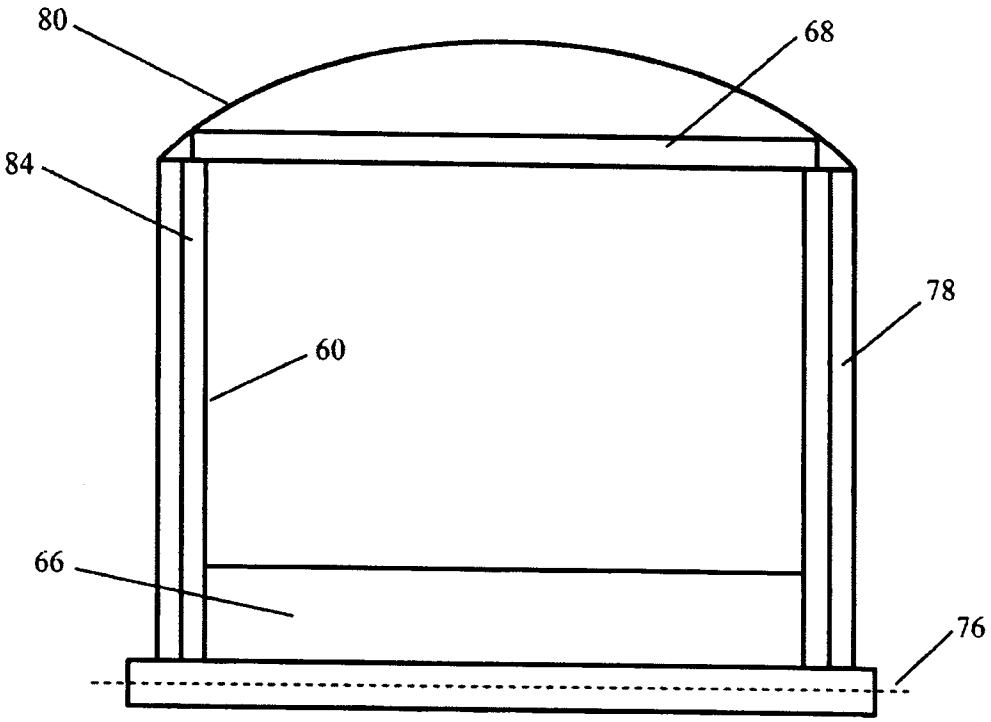
FIG. 6 depicts two illustrated examples of membrane LNG storage tanks.

Referring to FIG. 6, a Membrane system utilizes a membrane material capable of containing the LNG. The membrane type storage tank can be a pre-stressed concrete tank with a layer of internal insulation covered by a membrane, such as a thin stainless steel membrane, that is capable of containing the LNG and serves as the primary container 60. In this case the concrete tank 78 can support the hydrostatic load which is transferred through the membrane 60 and insulation (in other words, the membrane is not self-supporting or load bearing). The membrane can shrink and/or expand with changing temperatures.

Figure 7:
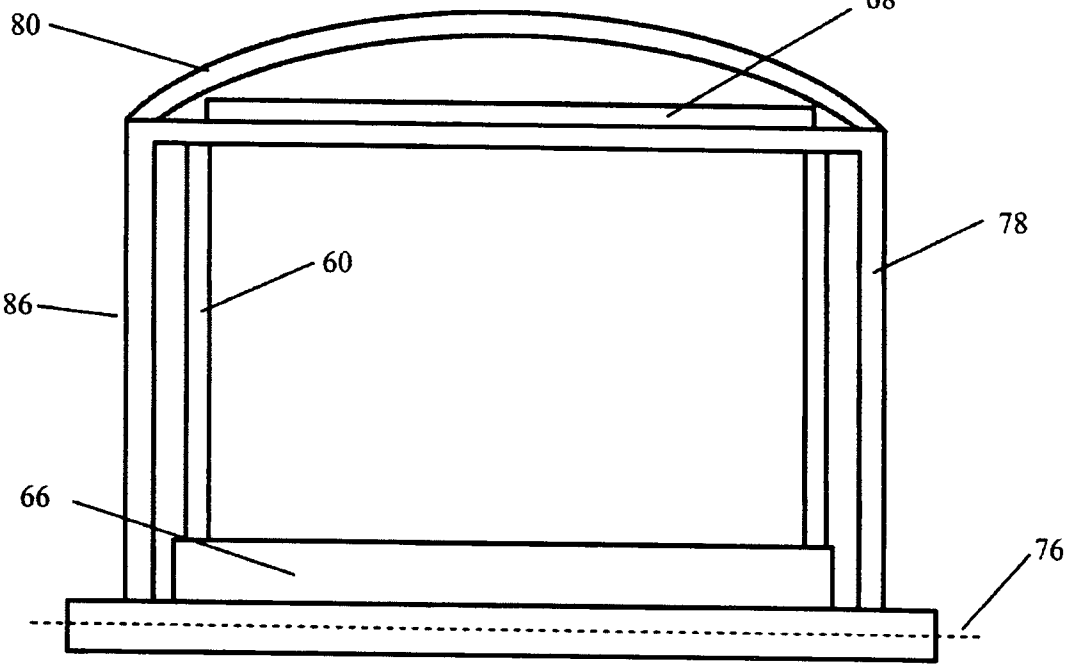
FIG. 7 depicts two illustrated examples of cryogenic concrete LNG storage tanks.

Another variation on the LNG tank designs include cryogenic concrete tanks as shown in FIG. 7 wherein the primary container 60 can be constructed of cryogenic concrete that is designed to withstand the cold temperatures of LNG service. The secondary wall 78 can be constructed of pre-stressed concrete and can have a carbon steel liner 86.

Figure 8:
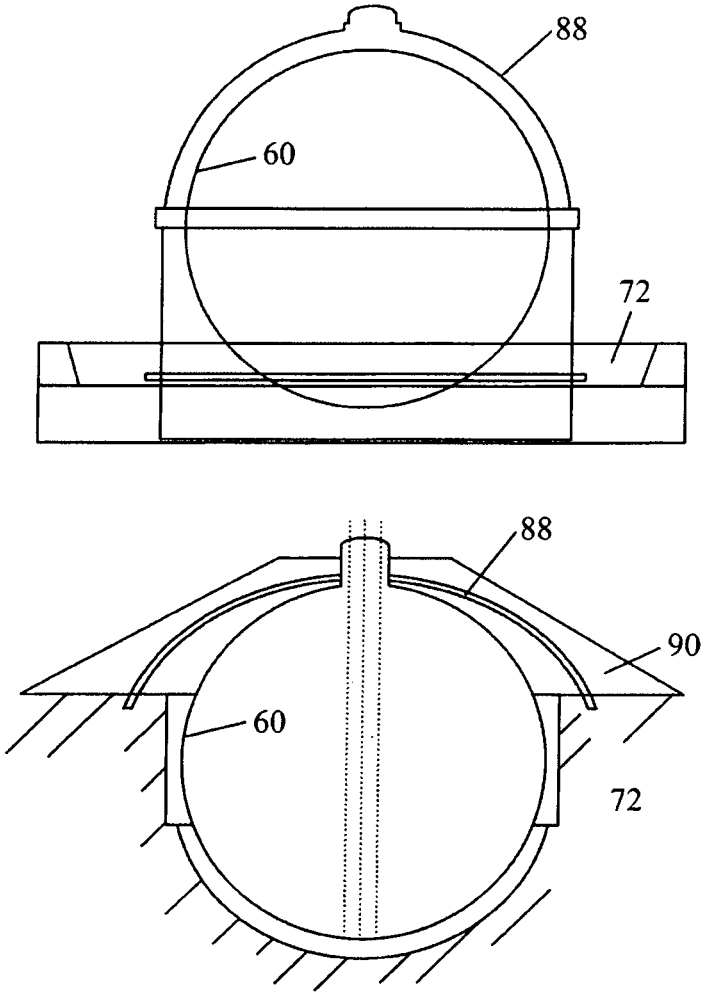
FIG. 8 depicts two illustrated examples of spherical LNG storage tanks.

Still another embodiment of LNG tank designs are spherical storage tanks as shown in FIG. 8. The primary container 60 can be enclosed within an outer shell 88 that in some embodiments can be partially buried or covered with an earthen berm 90.

It is a common industry practice to have all connections to the tank (e.g., filling, emptying, venting, etc.) through the roof so that in the event a failure of a line should occur it will not result in emptying the tank. Each tank can have the capability to introduce LNG into the top or the bottom section of the storage tank. This allows mixing LNG of different densities and can reduce rapid vapor generation. Filling into the bottom section can be accomplished using an internal standpipe with slots, and top filling can be carried out using separate piping to a splash plate in the top of the tank.

Vapor Handling

Figure 9:
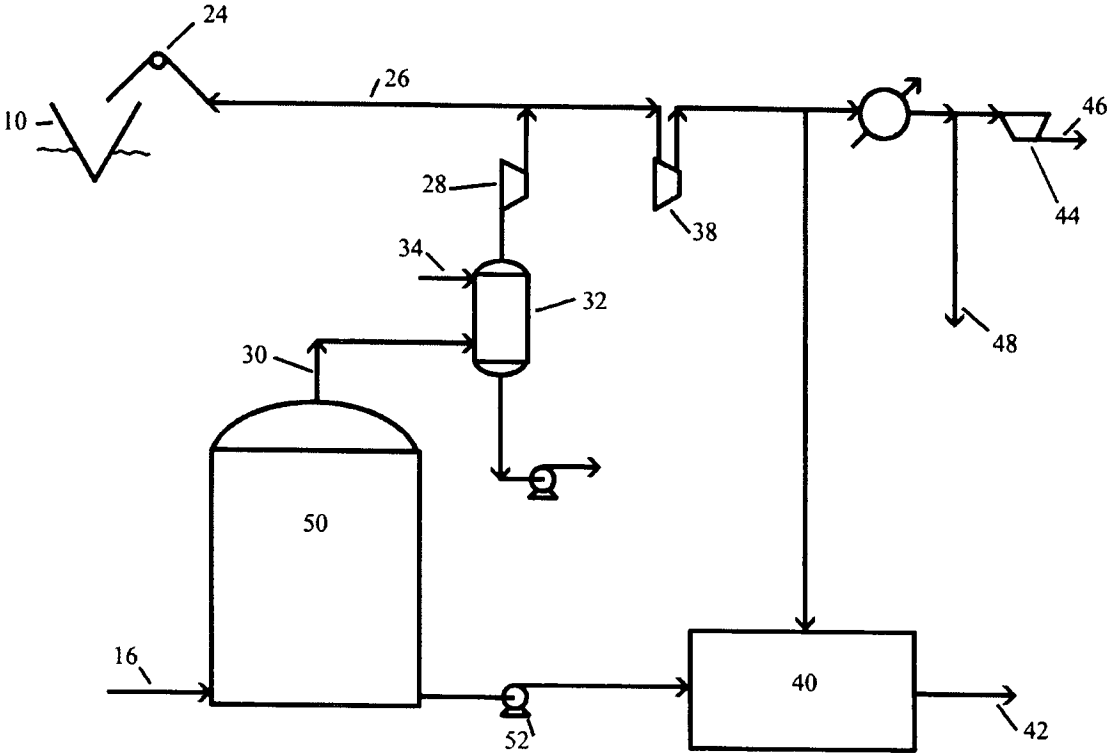
FIG. 9 depicts an illustrative schematic of a vapor handling system associated with a LNG receiving terminal.

Referring now to FIG. 9, during normal operation, boil-off gas (sometimes abbreviated as BOG) can be formed in the storage tanks by vaporization of LNG due to heat transfer from the surroundings. This gas can be collected in a header 30 that connects with a compressor suction drum 32. LNG can be injected 34 upstream of the drum to adjust the temperature of the vapor stream if the temperature rises above a certain level, such as for example minus 140° C. or minus 80° C. A boil-off gas recondenser can also be used to recover the BOG as a product, and can also provide surge capacity for LNG pumps. Boil-off gas from LNG storage tanks can be partially returned via vapor return line 26 to the LNG tanks in the ship while unloading is in progress. From the compressor suction drum 32, vapor can be routed to boil-off gas blowers 28 for return to the ship and/or to the boil-off gas compressors 38. The vapor that is not returned to the ship can be compressed and directed to a recondenser 40 that facilitates liquefying of the vapor such that it can be returned to the liquid storage or to LNG vaporization via line 42. If there is not enough LNG send-out to absorb the boil-off vapors during turndown or upset/emergency conditions, then the vapor can be compressed 44 to pipeline pressure and delivered via line 46 to be combined with the vaporized gas exiting the vaporizer 100 via line 58, or flared or vented 48 for safe disposal.

Vent System or Flare

During upset conditions, the amount of vapor generated can sometimes exceed the capacity of the pipeline compressor. If this occurs, the vapor van be vented to the atmosphere through an elevated vent stack or can be flared. In the case of an elevated vent stack, the vapor can be preheated to avoid flammable gas near ground level. The storage tanks themselves can be equipped with relief valves as a last line of defense against overpressure. Vacuum breakers can also provide protection against external overpressure.

First Stage LNG Send-Out Pumps

Multiple stages of send-out pumps can be used in the facility. For example, LNG can be pumped from the storage tanks by one or more first stage send-out pumps 52, and can be combined with the compressed boil-off gas in a recondenser 40. Low-head pumps can be located in each LNG storage tank. These pumps can operate fully submerged in LNG, and can be located within pump wells or columns for easy installation and removal. The pump wells can also serve as the discharge piping for the pumps and can be connected to the tank top piping. These pumps can deliver the desired LNG send-out flow and can also circulate LNG through the ship unloading piping to keep the lines cold between times when ships are being unloaded. In one embodiment, a suitable discharge pressure for an in-tank pump can be about 120 psig.

Two types of send-out pumps are a vertical pump with submerged motors, and vertical-shaft, deep-well pumps with externally mounted motors. Both types have been used and occasionally multistage horizontal pumps have been used. Vertical pumps are often chosen because of their low NPSH requirements and because the pumps can be kept in a primed condition.

Vertical Pump: A vertical pump with submerged motor can be constructed in such a manner that the pump with motor drive is hermetically sealed in a vessel and submerged in the liquid being pumped. The major advantage of this design is that the extended shaft with its associated seal is eliminated. Since the problems with most cryogenic pumps lies in the dynamic seals, eliminating them may provide a more reliable design. This type of design has the pump and motor surroundings 100% rich in LNG, and thus would not support combustion. Also the ingress of moisture is stopped and any problem due to differential shrinkage of materials is reduced or eliminated. In this design the LNG itself cools the motor windings and lubricates the motor bearings. This type of pump may be used in ship loading and unloading applications and for pumping of LNG out of LNG storage tanks. Utilizing a high head submersible pump can eliminate the need for second stage LNG send-out pumps.

Vertical-Shaft Pump: A vertical-shaft pump is configured with an externally mounted motor connected to a pump by a shaft, requiring a seal between the pump and shaft. The seal can be a mechanical seal. A vertical-shaft deep-well pump with an externally mounted motor can be used for LNG service, but can pose safety concerns regarding the possibility of failure of the mechanical seal on the extended shaft and possible exposure to LNG vapors to the externally mounted motor. If the first stage send-out pumps are located inside the tanks, they will likely be of the submersible design. If they are outside the tanks, however, then they will most likely be a considerable distance from the tanks; that is, the unloading pumps will be located out of the confines of the diked area, and the risk of exposure to LNG vapors is greatly reduced, thereby making vertical-shaft pump feasible.

Recondenser

The boil-off vapors generated during normal operations can be routed to a recondenser 40 and mixed with sub-cooled LNG to be condensed back to liquid. A stream of LNG from the in-tank pumps can be routed directly to the recondenser for this purpose. Recondensing the LNG vapors can eliminate flaring or venting for most operating conditions. The recondenser can house a packed bed that creates a large surface area for vapor-liquid contact.

Second Stage LNG Send-Out Pumps

The recondensed LNG liquid from the recondenser along with LNG from the storage tanks can be pumped by second stage send-out pumps 54 to a vaporizer unit 100. The vaporized send-out gas via line 58 is usually injected into a high pressure gas distribution system. In some embodiments, a suitable pressure for the send-out gas can be about 1200 psig. For this pressure multi-staged send-out pumps (booster pumps) are often required. The pumps can be high-head, multi-staged vertical can-type and take the LNG from the recondenser vessel 40 and boost up the pressure to the vaporizers 100 for the required pipeline pressure. A portion of the vaporized gas can be diverted for use as fuel in the regasification facility.

LNG Vaporizers

LNG from the storage tanks is transferred to a regasification unit where it can be re-vaporized. This unit can comprise one or more LNG vaporizers. In one embodiment, the unit can include multiple vaporizers operating in parallel, optionally with spares. Various types of vaporizers that can be used for this purpose include Open Rack Vaporizer (ORV); Submerged Combustion Vaporizer (SCV); Shell and Tube Vaporizer (STV); Reverse Cooling Tower (RCT); Fired Heater (FH); and Ambient Air Vaporizers (AAV). The vaporizers can be either direct or indirect in design, with indirect schemes utilizing an intermediate Heat Transfer Fluid (HTF).

Open Rack Vaporizer

Figure 10:
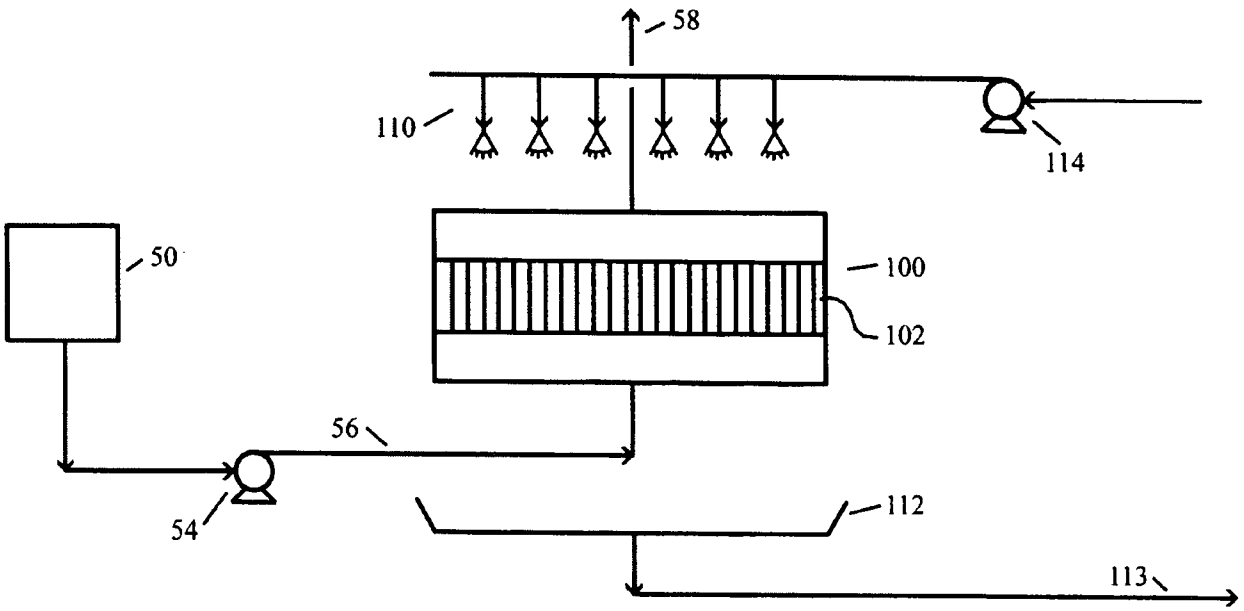
FIG. 10 depicts an illustrative schematic of an open rack heat exchanger used for vaporizing LNG.

Referring to FIG. 10, these vaporizers 100 can use water (e.g., sea-water) to heat and vaporize the LNG. For example, ORVs can use sea-water in an open falling film type arrangement 110 to vaporize LNG that enters via line 56 and passes through tubes 102 and exits via line 58. In one embodiment the water can fall over aluminum (aluminum-zinc alloy) panels and collect in a trough 112 before being discharged back to sea via line 113. The tubes 102 can be extended surface tubes to increase heat transfer area. The sea-water can pass through a series of screens to remove debris before entering the intake basin. The pumps 114 can be located in one or more bays within the intake basin. Contaminated seawater can affect the ORVs' heat exchange surface coating. Suspended solids, such as silt, should be minimized since it can also contribute to the erosion of coated surfaces. One screen design includes a dual barrier system to protect marine life from entering the seawater intake. Downstream of the coarse trash screen and upstream of the seawater pumps, a secondary barrier can be installed and may be constructed of a series of fine mesh fabric filters or wedge-wire screen panels. Microorganisms present in the seawater system can be affected and destroyed by the temperature drop and strong turbulent water circulation. The seawater organisms can also be affected by the residual sodium hypochlorite that is used as an anti-fouling chemical for protection against biological fouling. Chlorination units can provide chlorine to be dosed into the seawater at the inlet to the intake basin to control marine growth in the system, in a continuous or intermittent manner. Provisions can also be made for shock dosing of the individual pump bays as needed. The volume of water available at the project site must be evaluated, and detailed planning and modeling may be required to ensure that cold discharge water does not re-circulate back to the intake side.

Submerged Combustion Vaporizer

Figure 11:
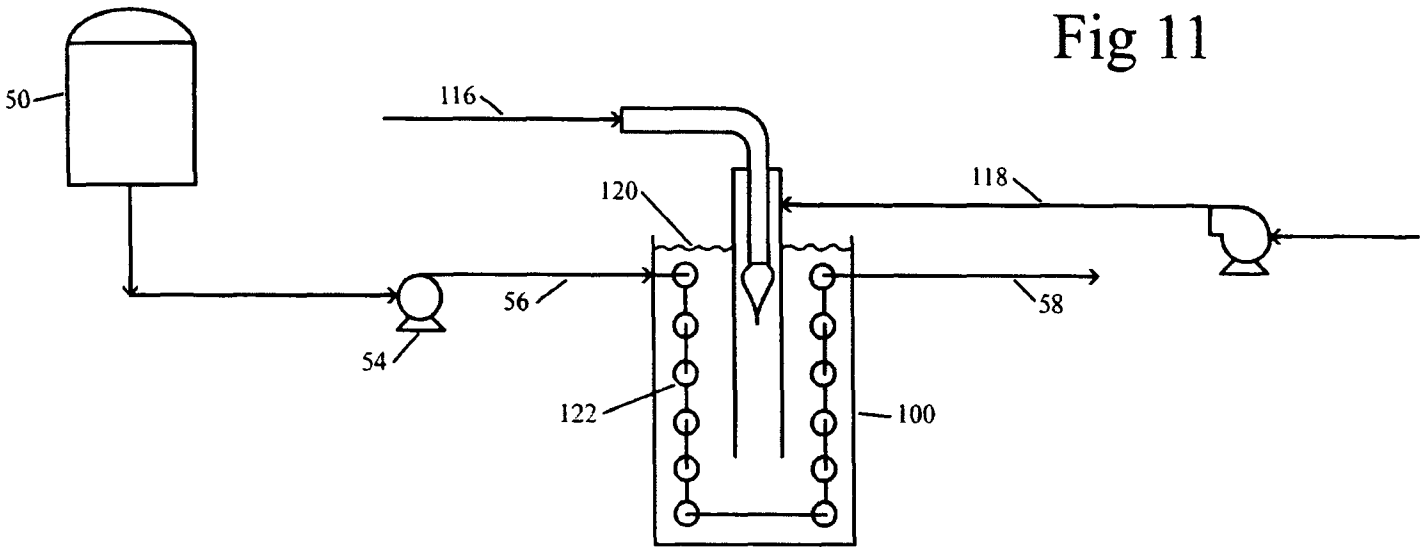
FIG. 11 depicts an illustrative schematic of a submerged combustion system used for vaporizing LNG.

Referring to FIG. 11, another alternative embodiment is a submerged combustion vaporizer (SCV) which uses a portion of the send-out gas as a fuel 116 for combustion that provides vaporizing heat. These vaporizers burn natural gas taken from the send-out gas stream 116 and combustion air 118 and pass the hot combustion gases into a water bath 120 that contains heating tubes 122 through which LNG passes. Wet flue gases can be vented from the top of the SCVs and the water product of combustion can be treated for PH control before being discharged to the sea or a waste water disposal system. Depending on the vaporizer capacity, single or multiple burners may be used.

Shell and Tube Vaporizer

Figure 12:
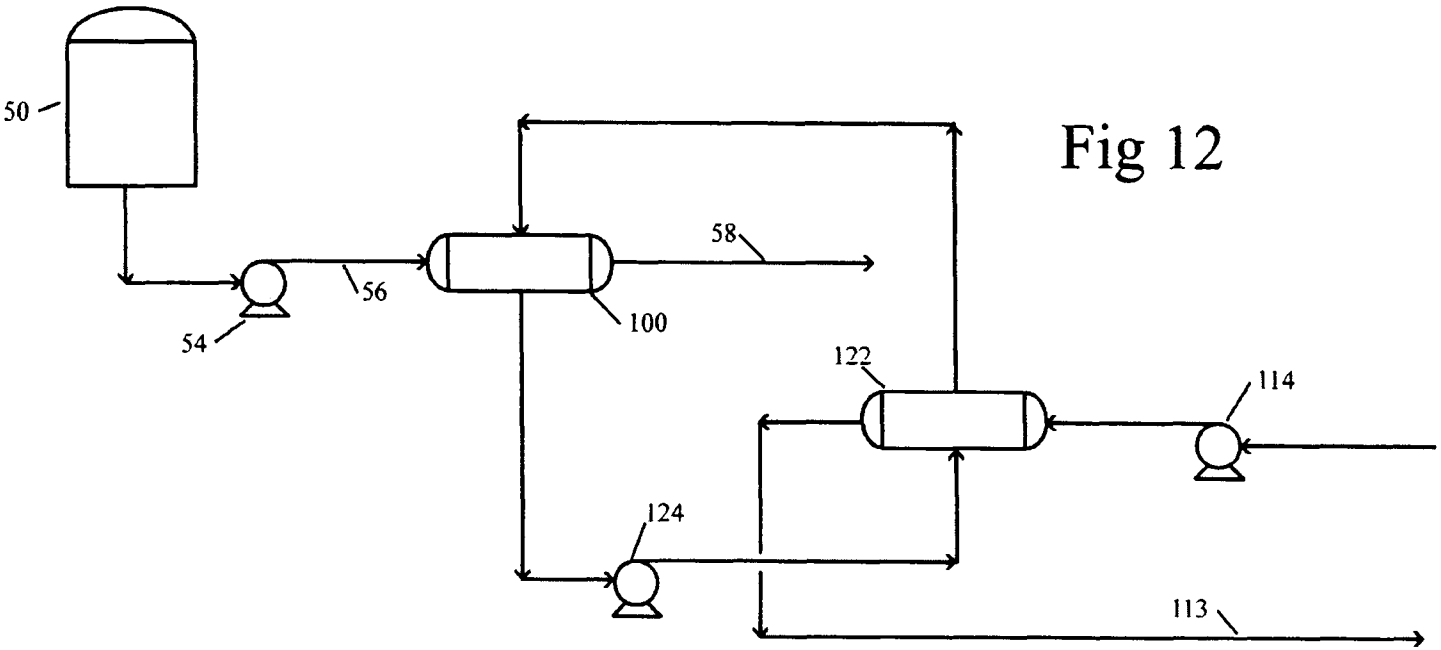
FIG. 12 depicts an illustrative schematic of an intermediate fluid system used for vaporizing LNG.

Referring to FIG. 12, Shell and Tube Vaporizers (STV) can be of an indirect heat exchange type utilizing a heat transfer fluid (HTF). The LNG from storage can be vaporized in one or more STVs 100. In the embodiment shown in FIG. 12 the LNG flows through the tubes while the HTF is on the shell side. The HTF which has been cooled through its exchange with the LNG can then be heated in a separate cross exchange with another fluid, such as sea water from pumps 114, which can also utilize a shell and tube exchanger 122. The HTF can be a fluid such as propane that can be vaporized by sea water in exchanger 122 and then condensed back to a liquid in its cross exchange with LNG in vaporizer 100. Various kinds of HTFs are available, such as for non-limiting examples, water and water solutions with ethylene glycol, polyethylene glycol or methanol. The selection of the type of HTF depends on its physical-chemical properties, operating costs, proven track records, and environmental and safety considerations. A circulation pump 124 can be used to circulate the HTF through its cycle. A fired heater is sometimes installed as an auxiliary source of heat.

Reverse Cooling Tower

Figure 13:
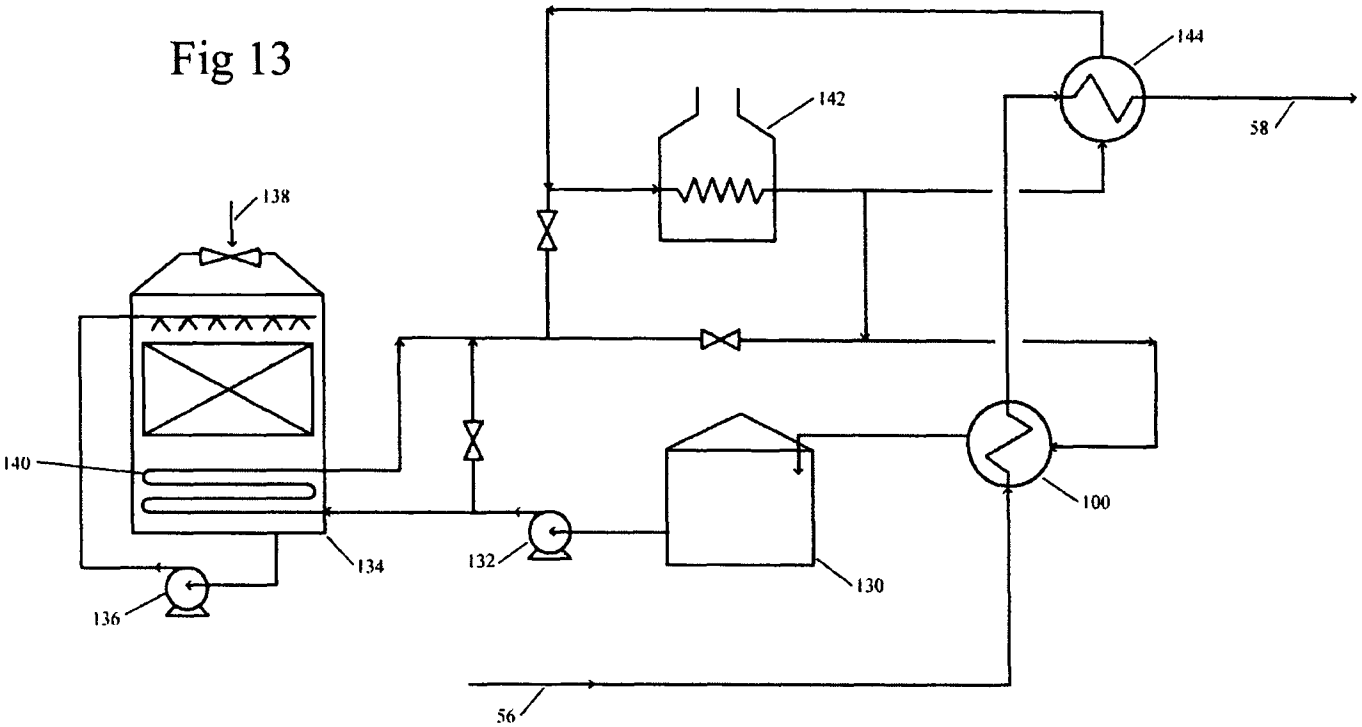
FIG. 13 depicts an illustrative schematic of a reverse cooling tower used for vaporizing LNG.

Referring now to FIG. 13, cold HTF from a HTF surge tank 130 can be sent via HTF circulation pump 132 to a Reverse Cooling Tower (RCT) 134 where it is warmed by heat exchange with water as a heat absorbing fluid. The cold water from the tower basin is circulated via pump 136 to the top of the tower 134. The incoming air 138 is cooled as it travels down the tower 134 and heats the cold water cascading down. Any moisture present in the incoming air is also condensed in the tower. The warm water in the tower basin heats up the HTF flowing through internal coils 140. The warmed HTF then circulates through the LNG vaporizer 100 and returns to the HTF surge tank 130. Liquid LNG enters the vaporizer via line 56 and is vaporized in the LNG vaporizer 100 and exits via line 58. A fired heater 142 can be utilized as a back up heating source to the RCT system, which can also include a trim heater 144 to provide additional heating on the vaporized gas 58.

Fired Heater

Fired Heaters (FH) have been widely used in process plants. The FH burner is typically sealed to eliminate the possibility of flash back and has complete combustion inside the burner. The controlled flame inside the heater is typically designed to eliminate the possibility of flame impingement on the tube surface. In a receiving terminal the FH can indirectly vaporize the LNG by heating a HTF which then transfers heat to the LNG through a heat transfer means such as a Shell and Tube Vaporizer (STV). FH can have high heat transfer coefficients which can result in a more compact design, thereby reducing space requirements.

Figure 14:
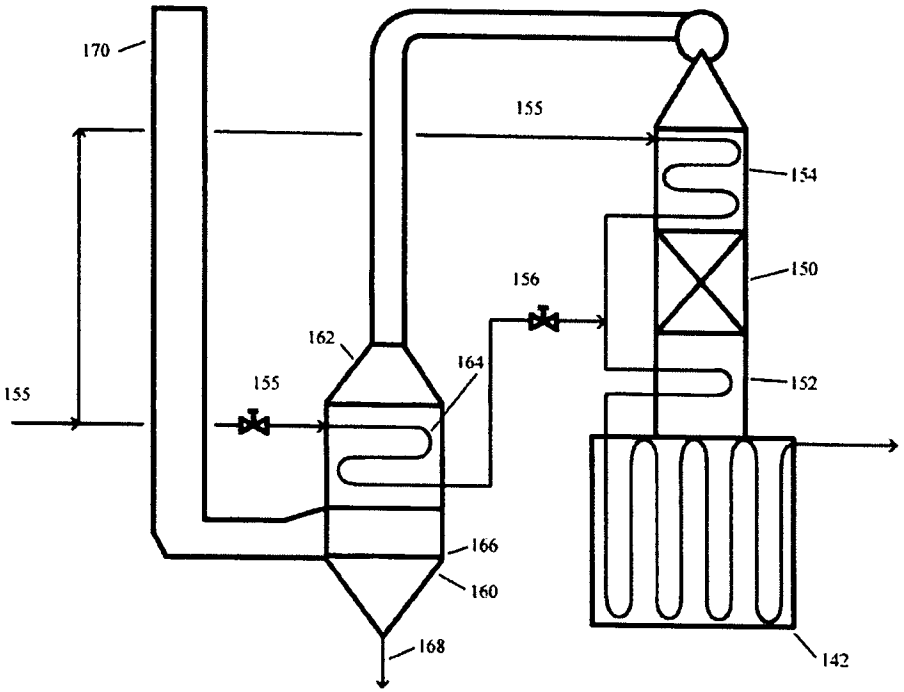
FIG. 14 depicts an illustrative schematic of a fired heater equipped with a condensing heat exchanger and a selective catalytic reduction unit.

Referring now to FIG. 14, a Selective Catalytic Reduction (SCR) 150 system can be fitted into a FH. Through catalytic reactions, SCR can reduce the NOx and CO emission to comply with environmental requirements. A FH equipped with SCR can in some embodiments eliminate over 99% of NOx and CO emission. The SCR can be installed between convection coils 152, 154 where the flue gas temperature is still high enough for the catalytic reaction.

The conventional FH, however, can have a lower thermal efficiency as compared to a SCV because of the high exhaust temperatures typical of a FH. The conventional FH with an 89% thermal efficiency is designed for an exhaust temperature of 300-350° F. (149-177° C.). One of the reasons for designing a FH with a high exhaust temperature is to avoid water condensation in the flue gas. Acid gas contained within the flue gas can dissolve in the condensate, resulting in an acidic condensate and requiring special corrosion resistant materials for the convection tubes.

Condensing Heat Exchanger

Referring again to FIG. 14, the concept of the condensing heat exchanger (CHX) 160 is based on removing latent heat from the flue gas coming from a FH. The flue gas can be directed through an inlet plenum 162 and flow across one or more banks of exchanger tubes 164, typically in a horizontal or downward direction. The tubes can be coated by a material, such as for example Teflon, to protect them from corrosion and scaling from the condensing flue gas. The flue gas can exit the heat exchanger through an outlet plenum 166, which can be made of Fiberglass Reinforced Plastic or other suitable material, which is typically located on the bottom of the exchanger 164. In a typical application cold HTF 155 is heated in the CHX, flowing countercurrent to the flue gas, then exits via line 156 and enters the convection 152 prior to entering the FH 142 and exiting via line 158 to flow to the LNG vaporizer. As the flue gas temperature within the CHX 160 approaches the water vapor dew point, condensation can occur on the tube 164 exterior. Droplets of condensate can form and fall over the tube bundle. This can enhance the latent heat transfer and at the same time can act to clean the tube surface. The condensate can be collected and removed at the bottom of the heat exchanger via line 168. The flue gas exits the stack 170. CHX optimization studies indicate that in some embodiments the flue gas temperature gas can be reduced below the water bubble point, which improves the thermal efficiency to a level almost equivalent to SCVs. Increasing the thermal efficiency of the condensing heat exchanger can result in lower operating costs and improved economics.

Ambient Air Vaporizer

Natural draft ambient air vaporizers (AAV) and fan-assisted forced draft air heater vaporizers (AHV) use air as a heating medium. AAVs typically require more plot space than AHVs. Exclusive use of AAVs and/or AHVs can reduce emissions and noise as compared to other alternatives. They may require construction of a LNG containment sump built under the vaporizers if direct air-to-LNG contact vaporizers are used. These systems can use single or multiple units in banks with common interconnection pipes. Utilizing ambient air as a heating medium can generate fog resulting from the cooling of the ambient air and the condensation of moisture within the air. Atmospheric conditions such as temperature, wind speed and humidity will be factors in fog generation and its dissipation. In some instances a resulting dense fog may develop and therefore will need to be considered and designed for.

Vertical heat exchange tubes having an extended length can facilitate the natural downward air draft that is generated from the increasing air density as it is cooled. The air density entering at the top will be less than the colder air leaving at the bottom. It is common knowledge that heated air will rise and that cooled air will fall. Fan assisted forced draft systems will typically involve fans that assist the natural downward draft of cooled air. Just as heat exchangers that dissipate heat will typically have upward flowing fan assisted air flow to reduce heated air recirculation adjacent to the exchanger, heat exchangers associated with LNG vaporization that are receiving heat from the air and therefore cooling the ambient air are typically designed with downward flowing fan assisted air flow to reduce any cooled air recirculation adjacent to the exchanger. The cooling of ambient air can result in a frosting or icing effect on the exchanger tubes. Defrosting operations may be required depending on conditions such as temperature, wind conditions and humidity. Defrosting can be accomplished in a number of ways, such as for example taking an exchanger out of service and letting its temperature increase, thereby melting all or a portion of any frost that may have formed, sometimes referred to as cycling the exchangers. Specialized heat exchange tubes are available that are designed to minimize frosting and/or assist with defrosting operations, for example, one tube design involves a tube having finned extensions extending radially away from the tube to increase the surface area. The tube can be a stainless steel tube that is clad, wrapped or otherwise in contact with an aluminum finned exchanger element.

Two types of AAVs are the direct air-to-LNG contact vaporizer and the indirect air-to-intermediate fluid-to-LNG vaporizer. The direct method can use air in either a natural or a forced draft arrangement, typically a vertical arrangement, in which the LNG flows through an exchanger element, such as for example a stainless steel tube that is clad with aluminum fins. Heat is transferred from the air to the exchanger element thereby heating the LNG inside. The indirect method can use an intermediate fluid between an LNG vaporizer, such as a shell-and-tube type vaporizer, and conventional air exchangers to reheat the fluid by ambient air. The intermediate fluid flows through the exchanger tubes; heat is transferred from the air to the exchanger element thereby heating the intermediate fluid inside. The intermediate fluid then flows through the LNG vaporizer and transferring heat to the LNG. Back-up facilities such as fired heaters can be included based on the terminal design availability and specific meteorological conditions.

Figure 15:
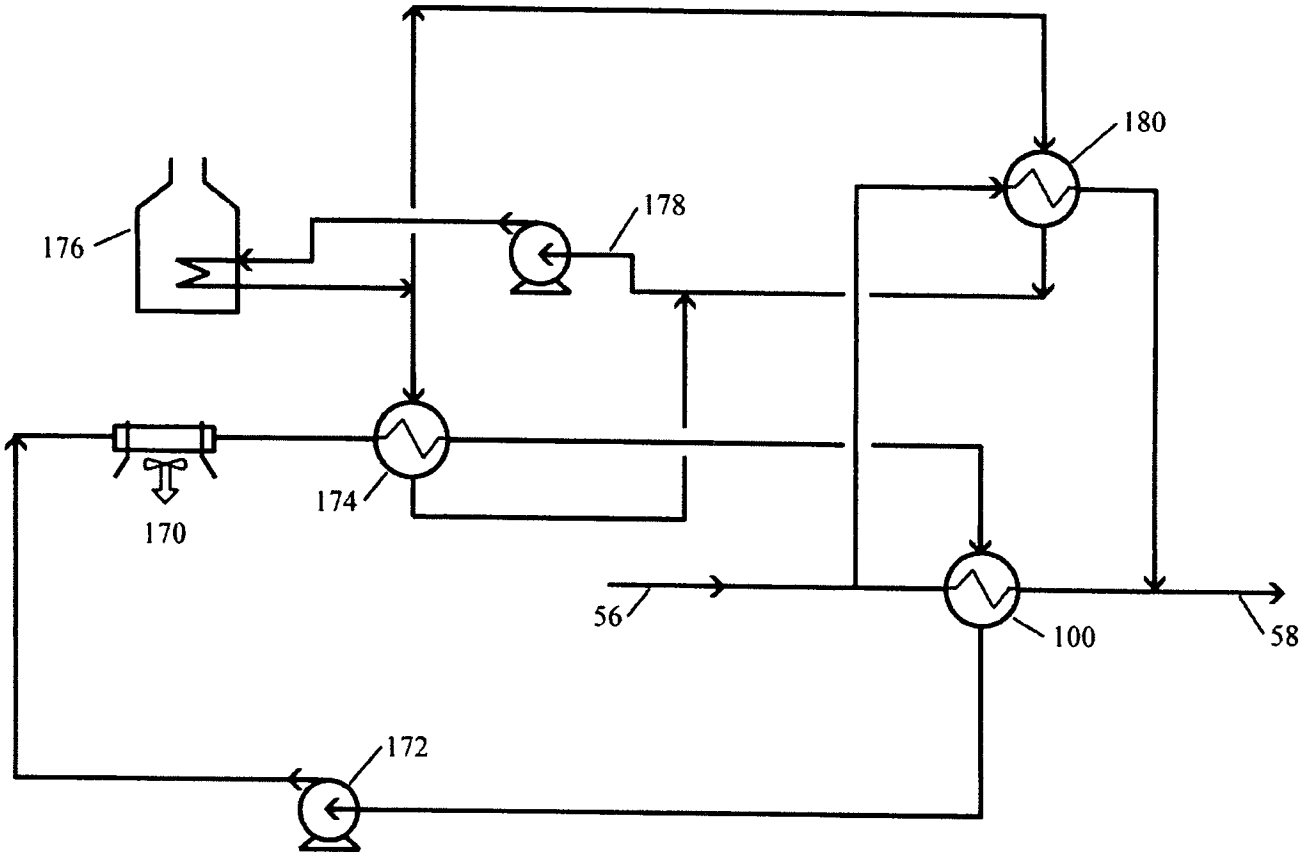
FIG. 15 depicts an illustrative schematic of a system having a forced draft air heater with a shell and tube vaporizer used for vaporizing LNG.

Referring to FIG. 15, the AHV method uses an intermediate Heat Transfer Fluid (HTF) that is pumped 172 between a vaporizer 100 and a forced draft air heater 170. Finned tubes with forced draft fans can be used to heat the HTF. Air flow direction from top to bottom is generally used to minimize cold air recirculation. Unless the ambient air temperature is too cold, continuous fan operation is recommended. In certain conditions, condensation of water from the air will occur as a result of the cooling effect on the air from the air heaters. Condensed water must be properly disposed of, which includes heating of the condensed water prior to disposal in order to minimize temperature pollution. There may be a trim heater 174 which the HTF can pass through before entering the vaporizers 100 which can provide supplemental heat to the HTF whenever the air is too cold to provide heat at the required temperature. One means of supplemental heating can be achieved by circulating a portion of the HTF through a fired heater 176 and then mixing the heated HTF with the colder HTF as needed to yield a supply of HTF at the desired temperature. The system can also be backed up by a hot water loop 178 which can provide heat to vaporize the LNG in a backup vaporizer 180 when the HTF loop is inoperable.

Three Shell Vaporizer

Figure 16:
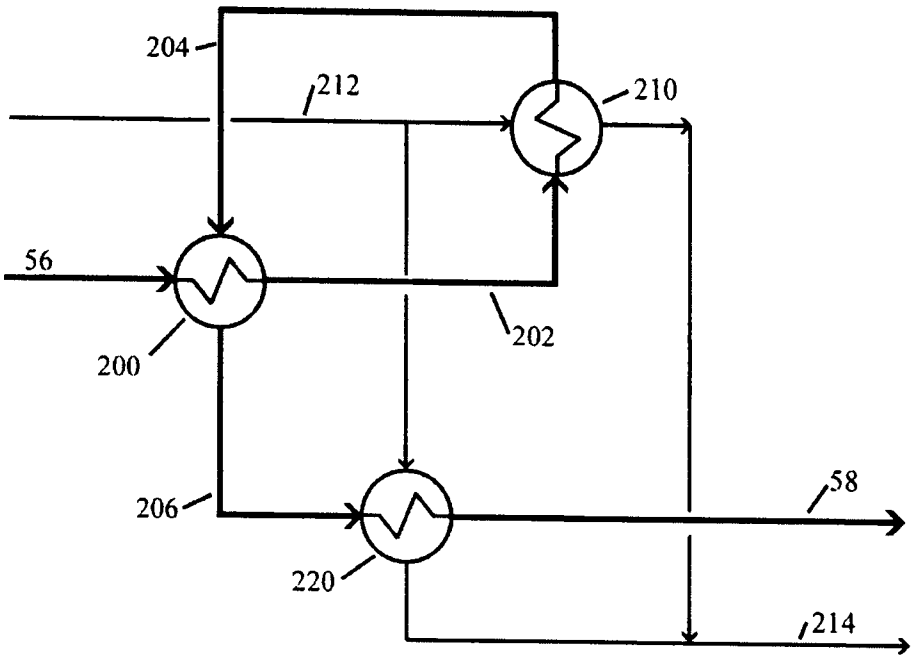
FIG. 16 depicts an illustrative schematic of a three-shell vaporizer system used for vaporizing LNG.

Referring to FIG. 16, to minimize the chances of freezing occurring inside the vaporizer, an arrangement of shell and tube exchangers in a three-shell assembly was developed. The three-shell scheme consists of one interchanger (LNG by LNG) 200 and two superheaters 210, 220 (taking heat from a HTF). The operating mechanism of the three-shell vaporizer is such that the incoming LNG 56 introduced to the first exchanger, the interchanger 200, is vaporized by heat exchange with warmed natural gas from the superheater 210, and exits the interchanger 200 via line 202. Vaporized gas in line 202 enters the superheater 210 where it is warmed by heat transfer with a hot HTF from line 212. The heated gas exits superheater 210 via line 204 and enters interchanger 200 where it transfers heat to the liquid LNG entering via line 56. This chills the gas from the superheater 210 by heat exchange with cold LNG and needs to be reheated in a second superheater 220 where it is warmed by heat transfer with a hot HTF from line 212 prior to exit via line 58. The cooled HTF exits superheaters 210 and 220 via lines 214 where it circulates to whichever HTF heating scheme is used. This scheme reduces the risk of HTF freezing in the vaporizer, allows a HTF with a higher freezing point than that of a conventional Shell and Tube Vaporizer. AHVs have only a small fraction of emissions compared to SCVs.

A sensitivity analysis with varying annual gas costs shows that the vaporization costs of the SCV and FH options increase directly with the fuel gas cost. The lowest vaporization cost is typically achieved by the ORV and the AAV because of the much lower fuel energy required for vaporization.

Send-Out Gas Specification

LNG can be received from several sources around the world and consequently a receiving terminal may receive LNG with wide compositional variations. The capability of a receiving terminal to assure gas interchangeably can enhance business opportunities. For example gas specifications of Pacific Rim countries such as Japan are generally significantly richer than the gas specifications of the United States of America. It is typically the responsibility of a receiving terminal to assure the regasified LNG has a heating value that is within certain specifications before it is sent to the customers. In some cases the imported LNG may have a higher heating value than the applicable specification calls for, and altering the heating value downward is desirable. Three approaches to lowering the heating value are diluting with inert gases, removing of heavier components (C2+) or LPG, or a combination of the above.

Inert gas injection: Nitrogen is a common inert gas used and can be low pressure or high pressure nitrogen. Typical US pipeline specifications limit the amount of inert material to 3 mol %, thus adding inert material is limited to 0.9-1.2 MJ/Sm3 (25-35 Btu/SCF) heating value reduction depending on the amount of nitrogen in the LNG as it is received. However, if this is the only adjustment needed the process is relatively simple and there are no other products to deal with besides LNG send out. High pressure gaseous nitrogen can be compressed to the pipeline pressure and injected downstream of the LNG vaporizers or be directed into the recondenser where it is absorbed by pressurized LNG. Nitrogen liquid can also be injected upstream of the recondenser either into the LNG stream or into the boil off vapor stream. Injecting upstream of the recondenser has the advantage of eliminating the need to pump or compress the nitrogen to high pressure. The injection of the pressurized nitrogen downstream of the vaporizers requires significant nitrogen compression. The cold LNG can be utilized to assist the compression by spraying LNG into the nitrogen stream, thus chilling the stream. The introduction of gaseous nitrogen through the recondenser requires the least compression horsepower and may be the least costly approach. Low pressure gaseous nitrogen can be compressed by dedicated compressors before entering the recondenser or be letdown in pressure and share the boil off gas compressors. Nitrogen injection can also be done using liquid nitrogen.

Removing Heavier Components: Removing heavier components that may be present, such as propane, butane or higher hydrocarbons, referred to as LPG, or ethane or higher hydrocarbons, referred to as C2+, is one manner of reducing the heating value of a natural gas stream. Herein the term LPG extraction can include ethane extraction. Aside from being versatile (able to change gas properties over a wide range), LPG extraction yields light hydrocarbon products that can have significant market values as final products or feedstocks. All LPG extraction schemes rely on volatility differences of components. One difficulty with this approach is that the operating pressures of fractionation towers are generally below pipeline delivery pressures, therefore the pressure of the residue gas after LPG extraction must be boosted. The heart of a LPG extraction scheme is a distillation column such as a demethanizer or a deethanizer tower, either of which herein can be referred to as a LPG extraction column. Other associated facilities for product handling may also be provided. The upper limit in operating pressure for a typical LPG extraction column is about 667 psig, the critical pressure of methane. Lowering operating pressures not only reduces column cost but also facilitates component separation and reduces reboiler duties. Pipeline pressure specifications are region specific and can be as high as 1500 psig or more for long distance transportation. Pressure boosting of the residue gas from the LPG extraction column is required to meet the high pressure specifications. The LPG extraction column can include an overhead condenser and can include reflux of condensed overhead product back into the LPG extraction column for overhead product specification control.

Existing LPG extraction schemes can be classified into three categories based on the handling of the residue gas and include: Residue compression (A); Residue compression and condensing (B); and Residue condensing (C).

In each scheme, LNG feed via line 300 is heated in a preheater/condenser 302 and enters a LPG extraction column 310. Overhead from the LPG extraction column 310 exits via line 312 and bottoms product of LPG product exits via line 314.

Figure 24:
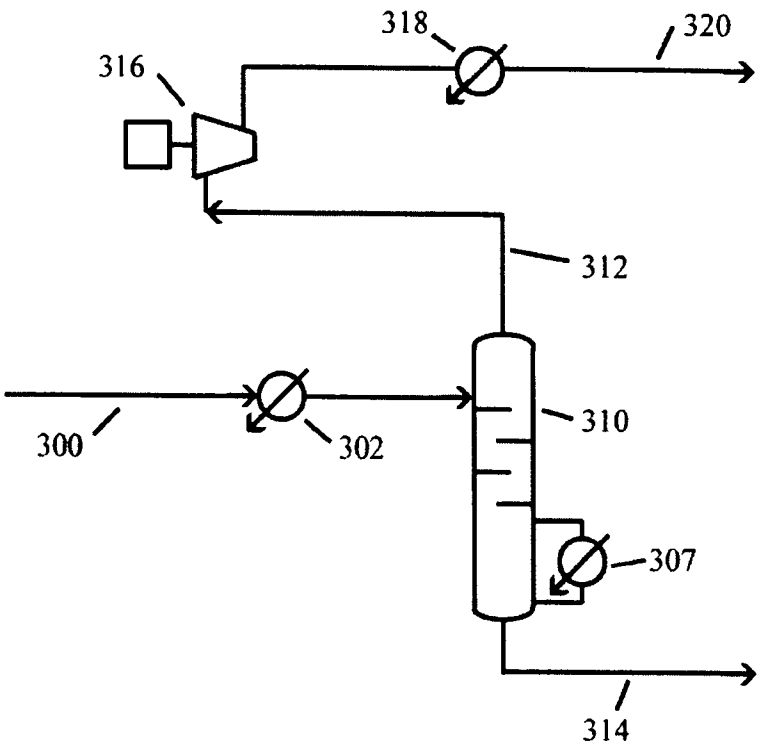
FIG. 24 depicts an illustrative schematic of a residue compression system for extracting NGLs from a LNG stream.

A flow diagram for the process of Category A, utilizing residue compression is shown in FIG. 24. It has good flexibility with no theoretical lower limit in operating pressure and good operability as it is insensitive to inlet LNG temperature and LPG extraction column 310 heat input 307. This scheme is a straightforward process with no phase changes; however, it can have high capital and operational costs due to high horsepower requirements. The LPG extraction column overhead 312 is compressed by compressor 316 and then heated by a trim heater 318 prior to exiting to the pipeline via line 320. The LPG extraction column heat input can be provided in one or more reboilers 307; the reboiler heat duty can be supplied by a heat transfer fluid.

Flow diagrams for various embodiments utilizing residue condensing schemes in Category C are shown in FIGS. 28-31. They require absorbers or exchangers to recondense the residue gas. The recondensed LNG is then pumped 322 for pressure boosting and vaporized 324. This process is more complex than residue compression because two phase changes are involved. When properly designed, residue condensing is less expensive to install and operate than residue compression, but has reduced flexibility due to the relatively high LPG extraction column operating pressure and reduced operability as it is sensitive to the LNG inlet temperature and LPG extraction column heat input.

Figure 25:
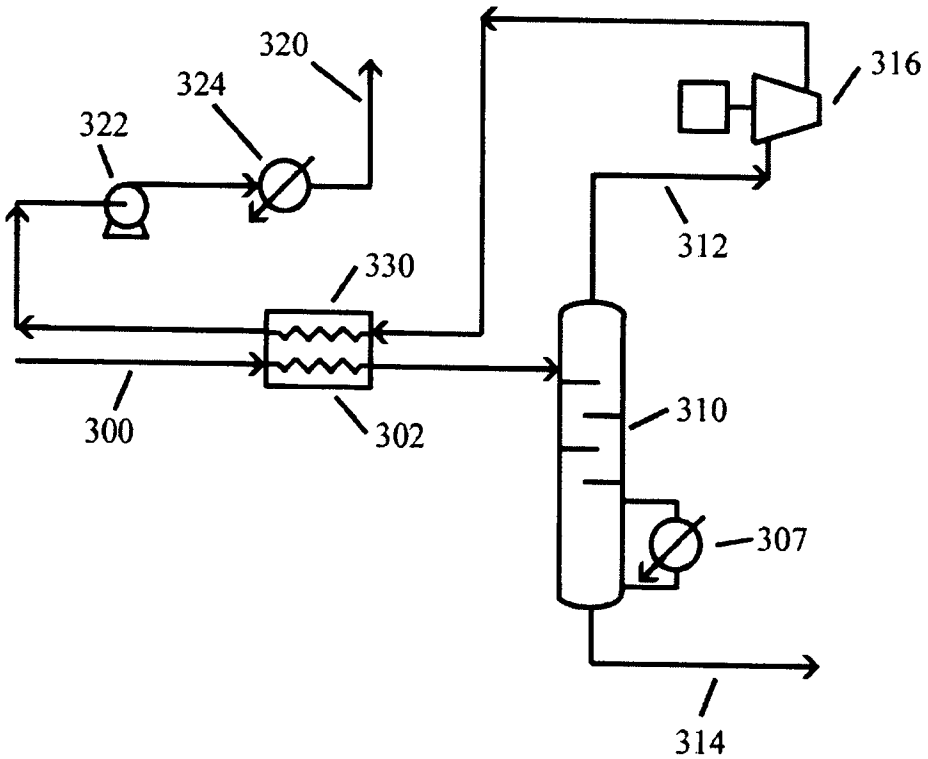
FIG. 25 depicts an illustrative schematic of a residue compression and condensing scheme for extracting NGLs from a LNG stream.
Figure 26:
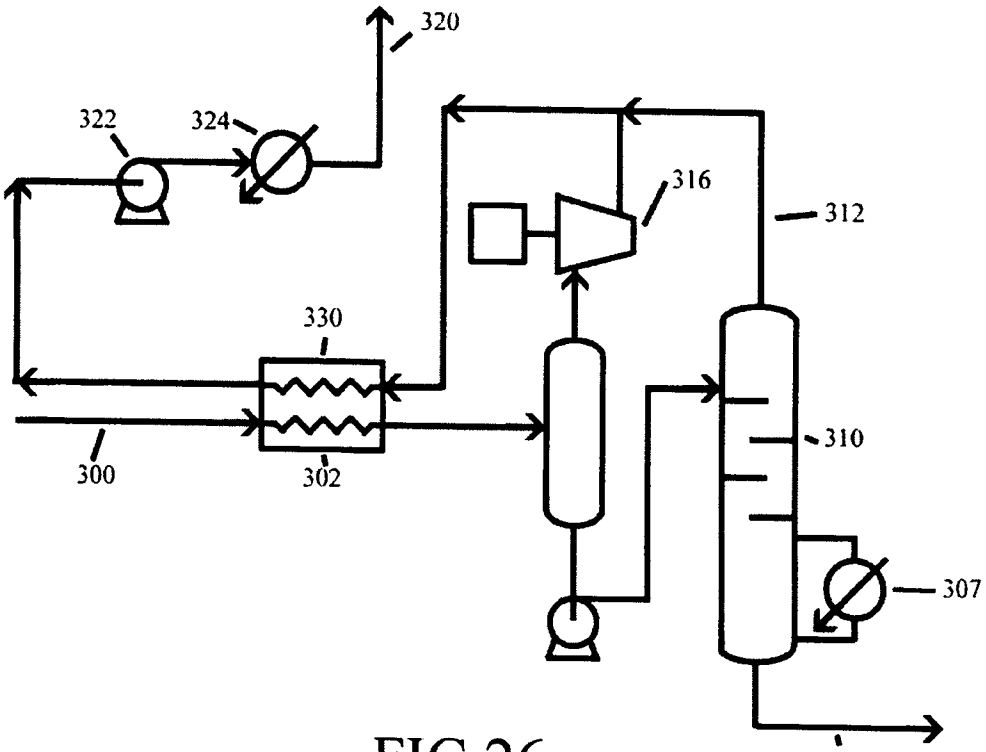
FIG. 26 depicts an illustrative schematic of a residue compression and condensing scheme for extracting NGLs from a LNG stream.
Figure 27:
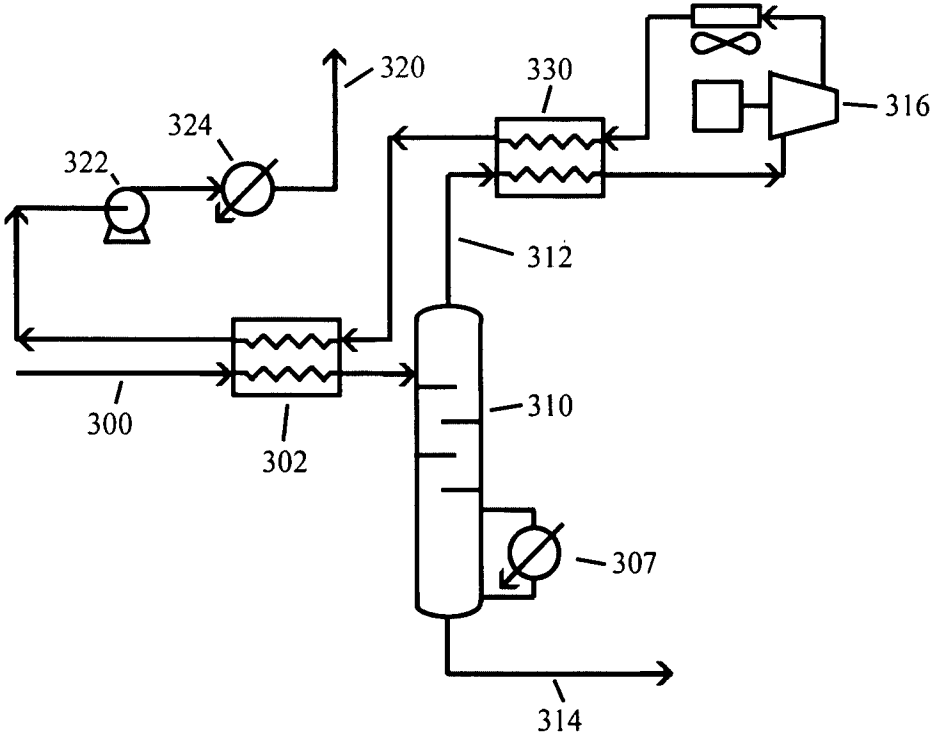
FIG. 27 depicts an illustrative schematic of a residue compression and condensing scheme for extracting NGLs from a LNG stream.
Figure 28:
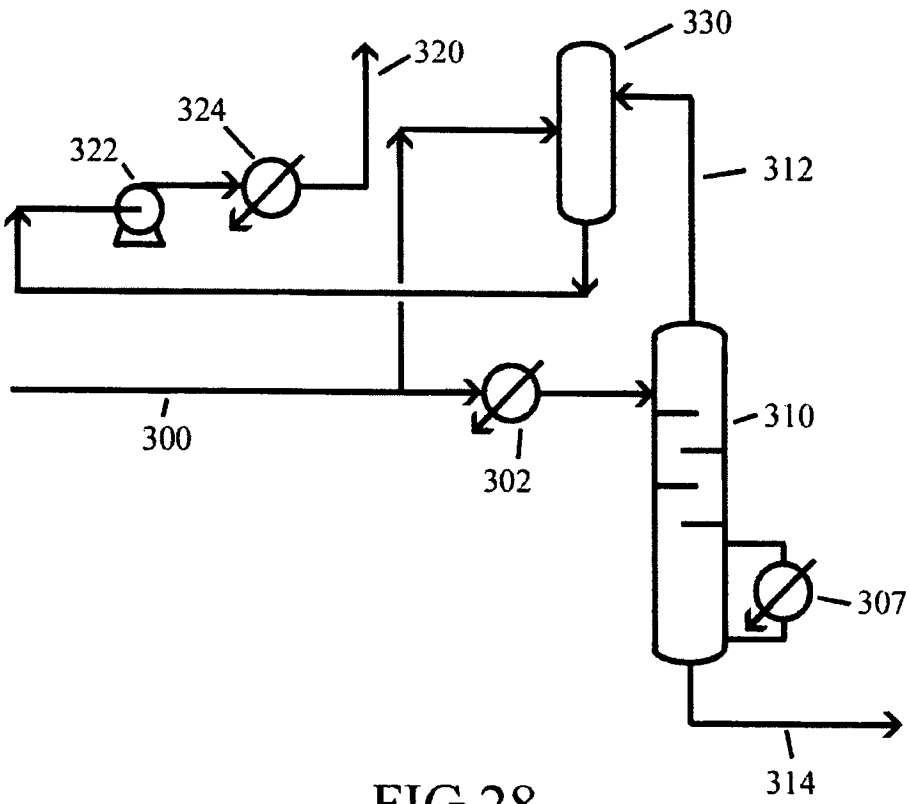
FIG. 28 depicts an illustrative schematic of a residue condensing scheme for extracting NGLs from a LNG stream.
Figure 29:
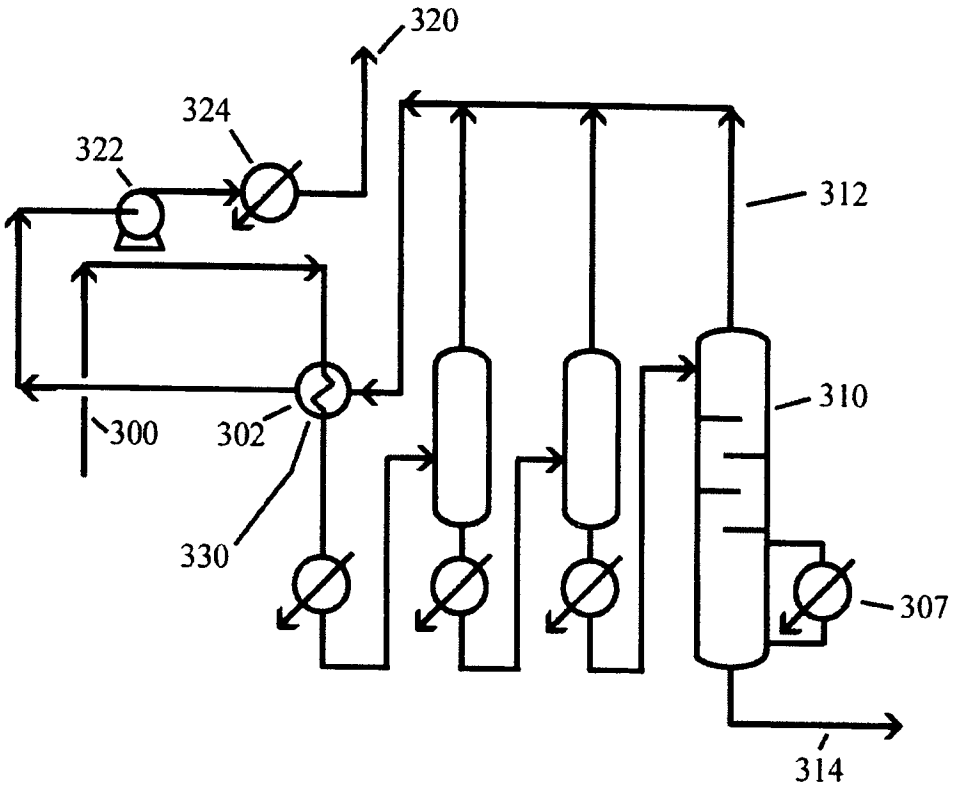
FIG. 29 depicts an illustrative schematic of a residue condensing scheme for extracting NGLs from a LNG stream.
Figure 30:
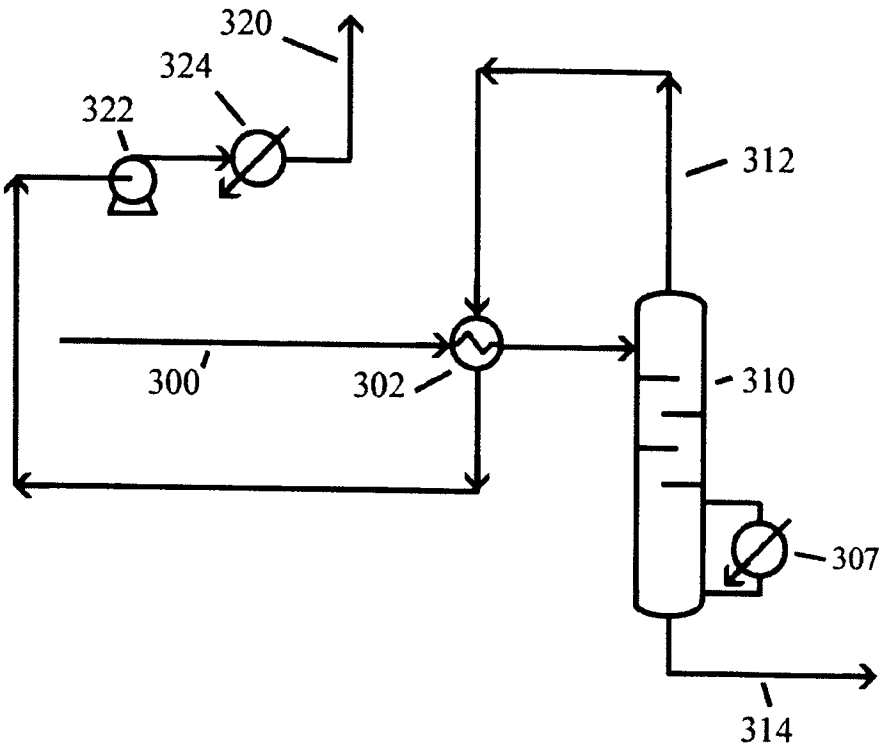
FIG. 30 depicts an illustrative schematic of a residue condensing scheme for extracting NGLs from a LNG stream.

Several schemes, shown in FIGS. 25-27 are combinations of residue compression and residue condensing and are put in Category B. They require compression, although not to the extent as residue compression. These schemes achieve significant savings in compression horsepower and have improved process flexibility and operability.

Figure 32:
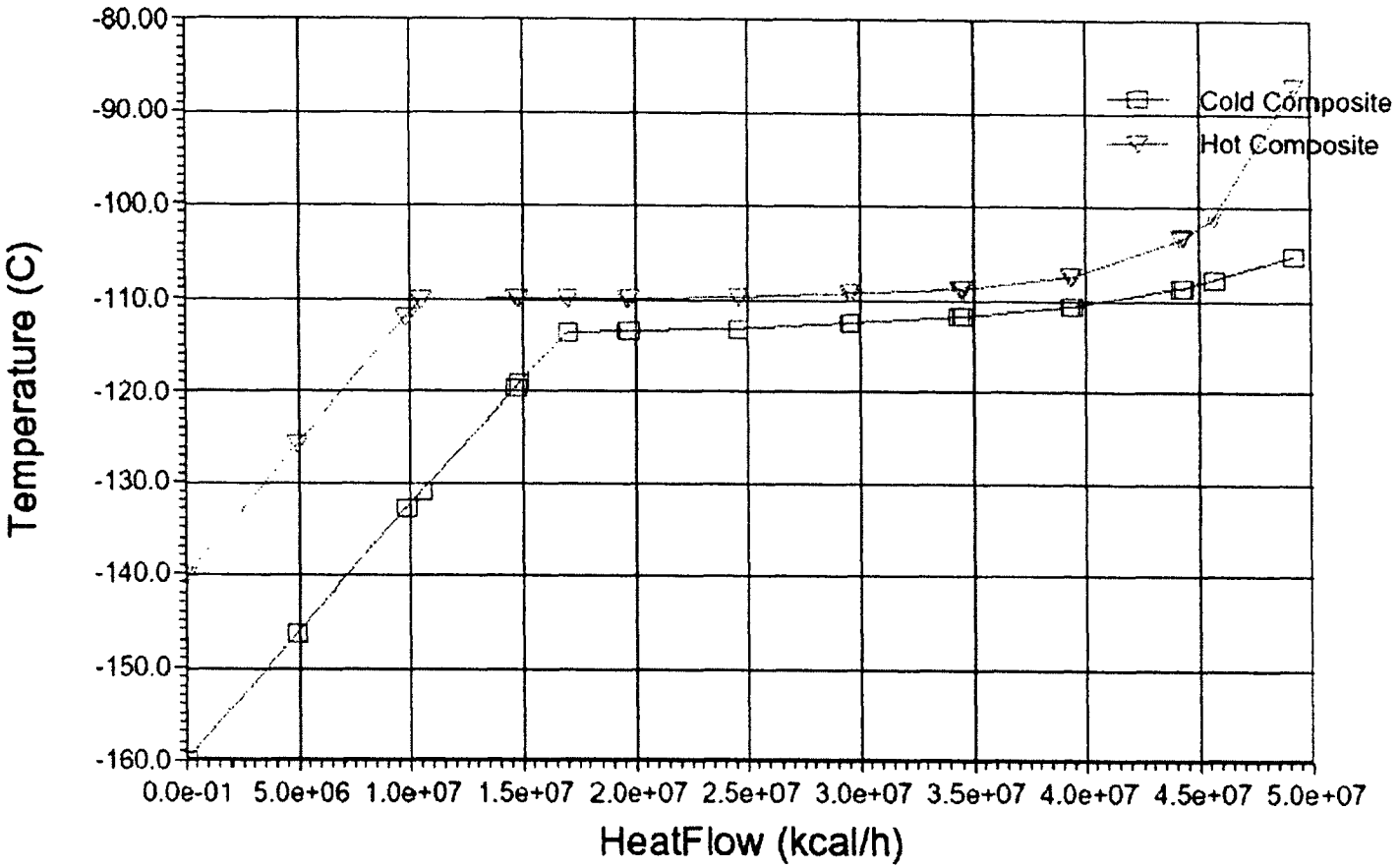
FIG. 32 is an illustrative graph of heating and cooling curves for residue compression and condensing schemes.
Figure 33:
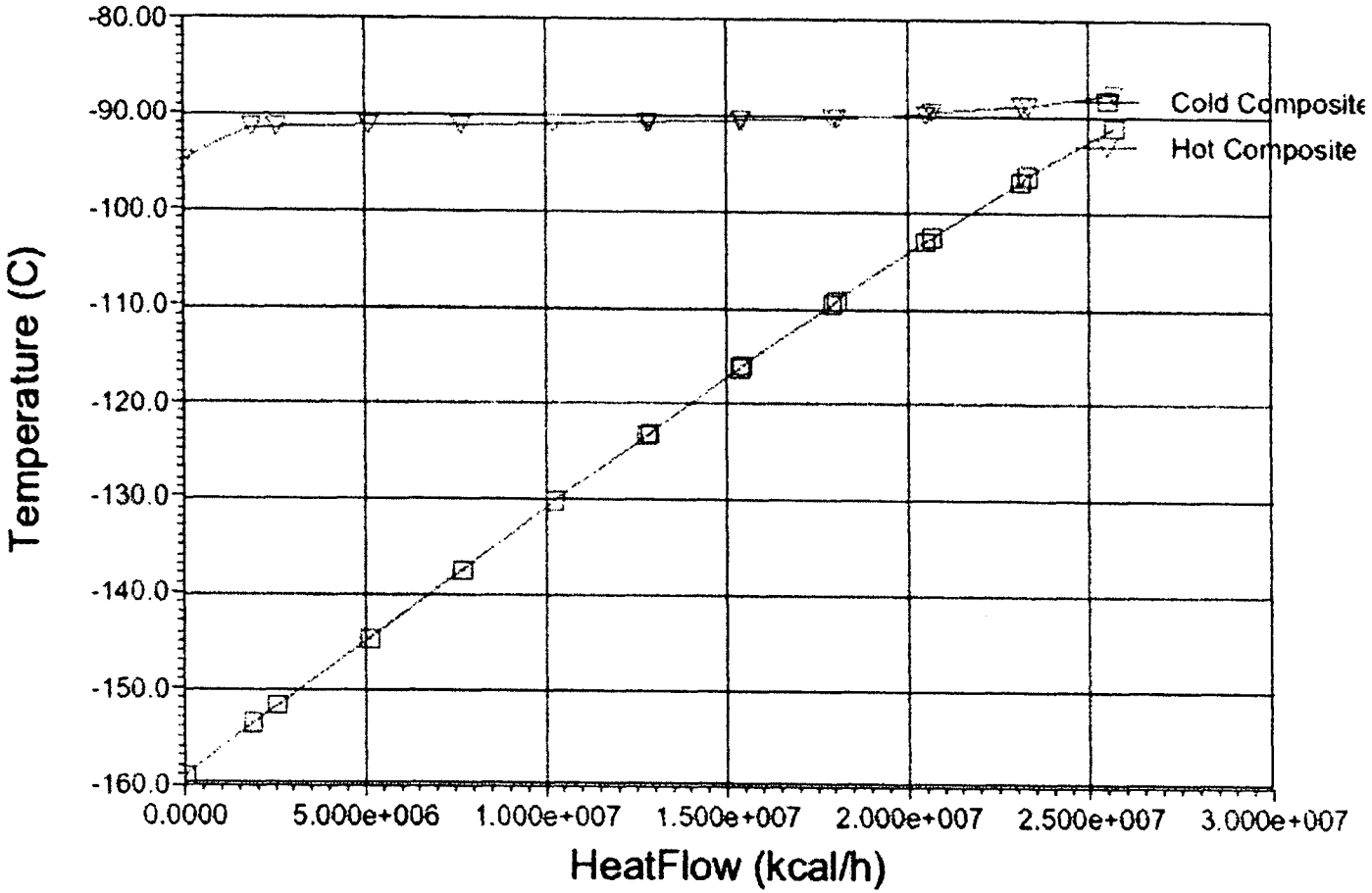
FIG. 33 is an illustrative graph of heating and cooling curves for residue condensing schemes.

Exergy is a measure of the maximum amount of work potentially extractable from a given thermal source. By the second law of thermodynamics, the greater the irreversibility of a process, the greater the exergy loss. Minimizing the exergy loss is of interest if the cold energy of LNG could be used to generate power. FIGS. 32 and 33 show typical heating-cooling curves of the LNG pre-heater/condensers in Categories B and C, respectively. For schemes in Category B (FIG. 32), there is a close match between heating and cooling sides. This close match indicates small exergy loss, although the advantage is gained at the expense of large exchanger areas. FIG. 33 shows schemes in Category C, and these factors are simply revered.

The improved flexibility and operability of Category B over C can be explained by FIGS. 32 and 33 as well. The prerequisite of pumping LNG to boost pressure is the total condensation of the residue gas in a residue condensing scheme. To meet this requirement, sufficient cold energy in the inlet LNG must be available to condense the residue gas without incurring temperature cross-over in the pre-heater/condenser. The processes of Category C (FIG. 33) achieve this by maintaining the inlet LNG at sub cooled condition (by raising the pressure) and returning the residue gas at a relatively high temperature to avoid cross-over. However, the operating pressure of the LPG extraction column is limited by the methane. Thus, there is a limited pressure range in which the residue condensing scheme works, and limited capability to handle varying LNG inlet temperature, extraction levels and compositions. The processes of Category B (FIG. 32) accept some increase in equipment cost and compression energy by adding vapor compression as a design variable. This vapor compression effectively eliminates the possibility of temperature cross-over. It allows a wider range of LPG extraction column operating pressures, increasing flexibility, and also enables the facility to handle larger variations in LNG inlet temperature and compositions, increasing operability.

Figure 31:
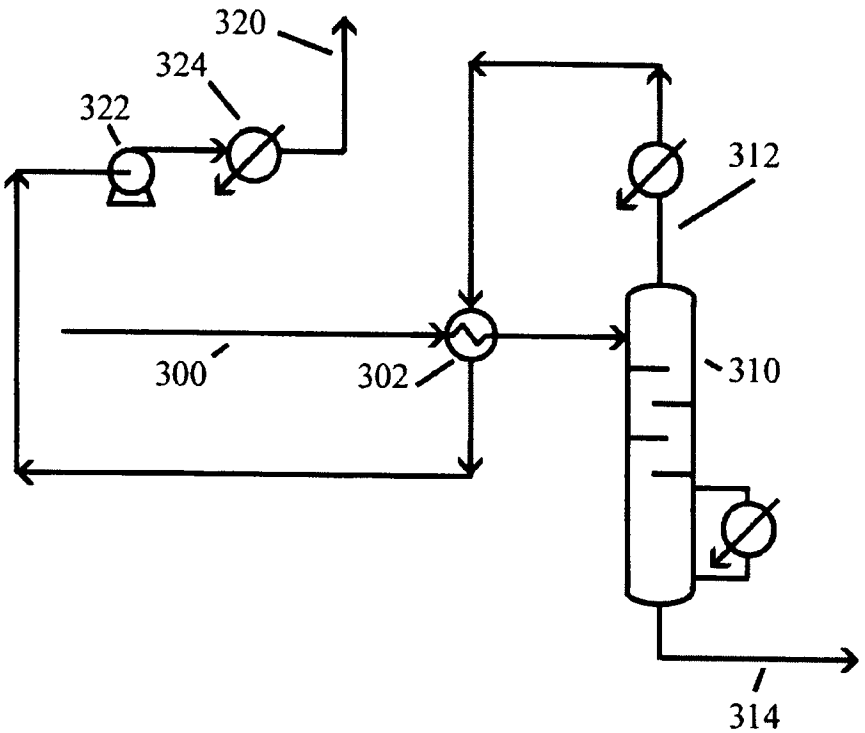
FIG. 31 depicts an illustrative schematic of a residue condensing scheme for extracting NGLs from a LNG stream.
Figure 34:
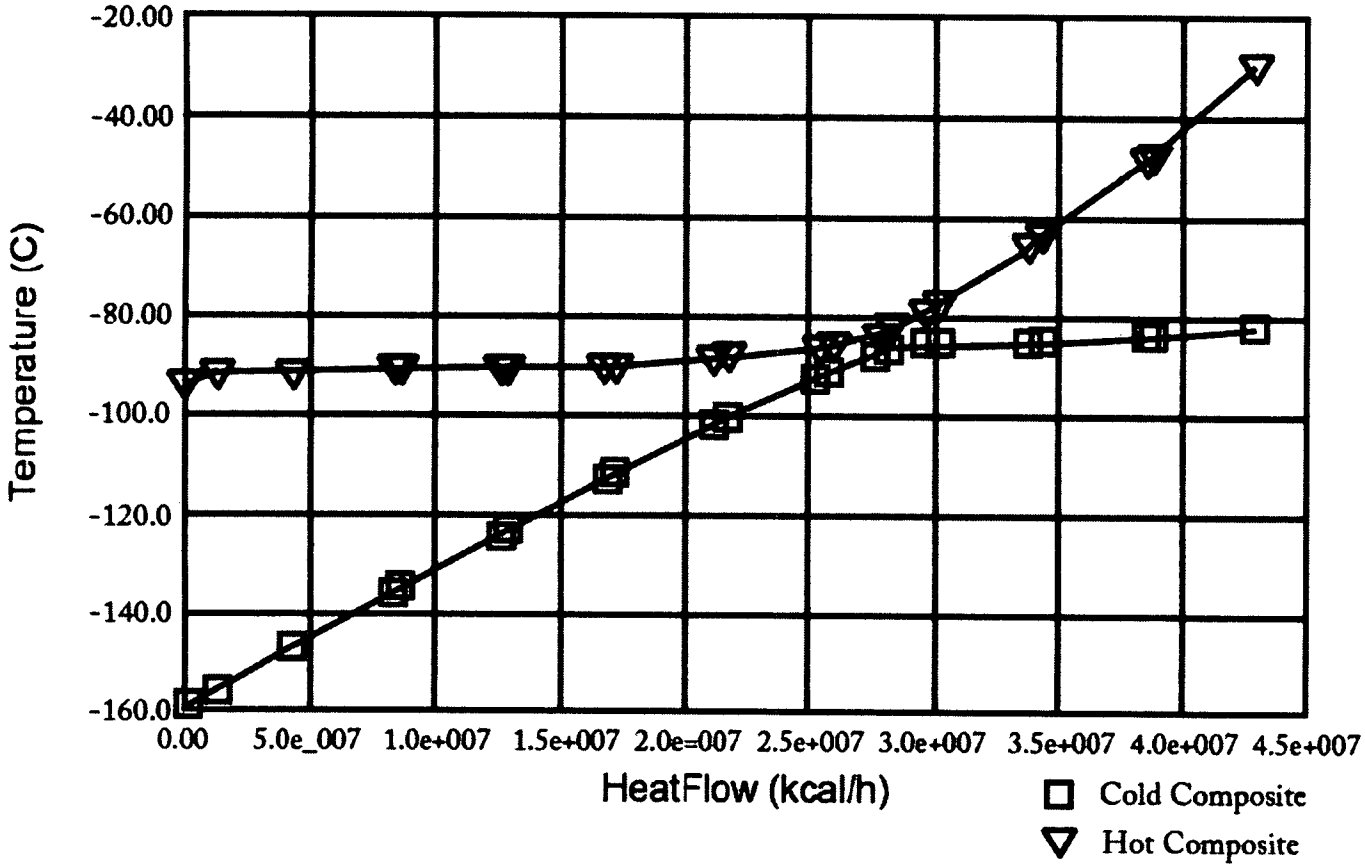
FIG. 34 is an illustrative graph illustrating the effect of a residue gas heater on a residue condensing scheme.

There are methods to improve the flexibility and operability of Category C schemes. FIG. 34 demonstrates the impact of adding a residue gas heater in Category C, as shown in FIG. 31. The added exchanger raises the residue gas to a higher temperature to avoid the temperature cross. The same amount of heat, if it goes through the LPG extraction column reboiler, would significantly reduce LPG recovery level.

In a typical LNG receiving terminal there are three major capital expenditure areas, which are: marine facilities (including seawater intake facilities if applicable); LNG storage tanks; and process equipment including LPG extraction. The inclusion of LPG extraction facilities can impact the selection of the plant heat source which can also affect environmental aspects. Optimization of LPG extraction facilities should be an integral part of the total plant design.

Figure 35:
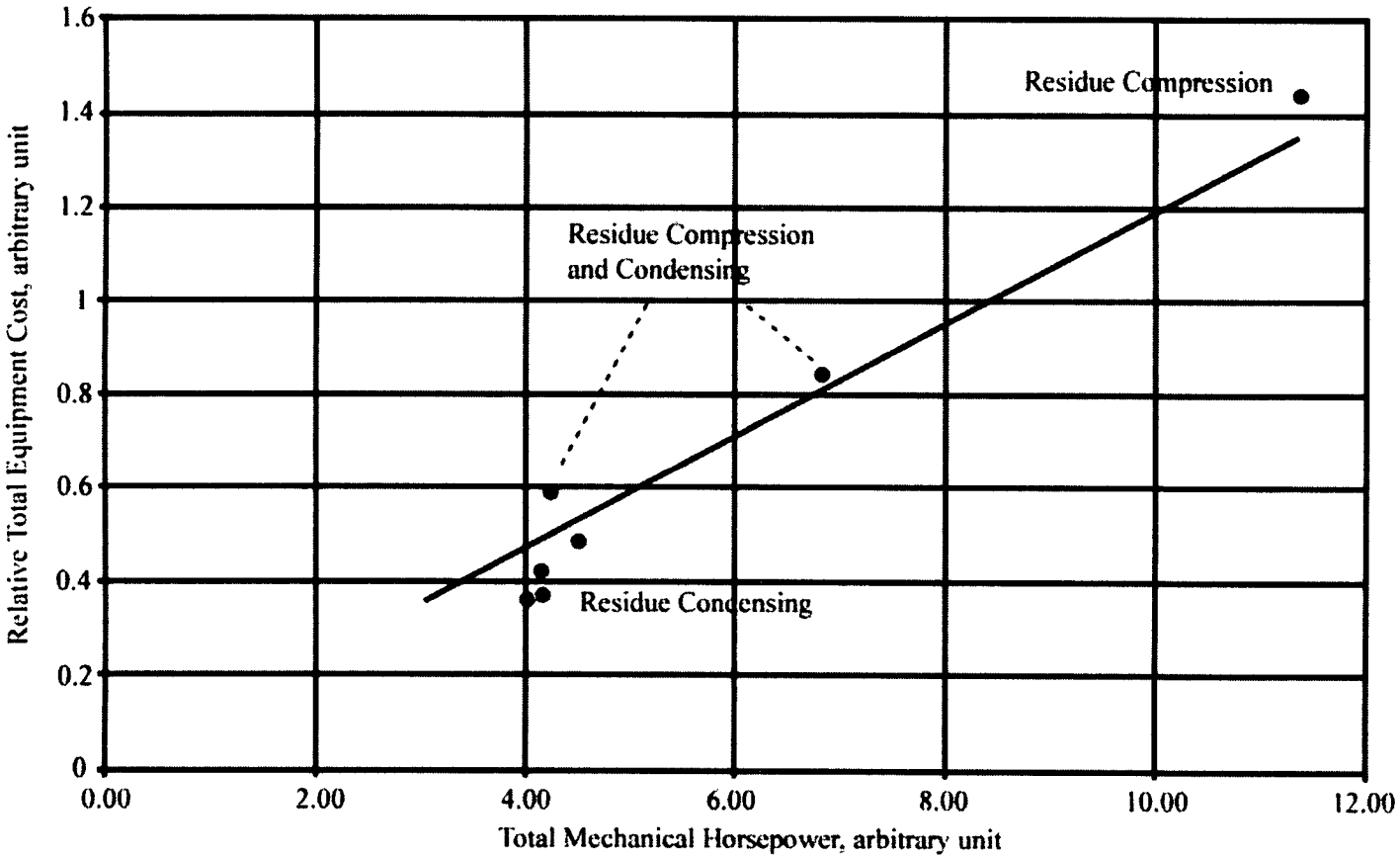
FIG. 35 is an illustrative graph of an indexed comparison of cost for various NGL extraction schemes.

Using the equipment cost as a starting point, FIG. 35 provides an indexed comparison for various LPG extraction facilities. Only key equipment items are presented in the figures. The heat source for operating the fractionation column (furnaces and heating medium circuit) and LPG product handling facilities are excluded.

The capital cost can be loosely correlated by the total mechanical (compression and pumping) horsepower. Compression horsepower should be minimized whenever possible because the contribution by compressors is dominant in cost evaluations. For example, between the two schemes presented in FIGS. 25 and 26 under Category B, the one in FIG.

26 can significantly reduce the compression requirement by installing an intermediate vapor separator. Without major compression requirements, such as schemes in Category C, no specific design distinguishes itself from others from an equipment cost viewpoint. The optimization of capital cost should consider other factors, such as heat sources for reboilers, C2 recovery level required, client's preferences, etc.

The LPG extraction facilities may also impact the operating cost. Reboilers of fractionation columns demand relatively high temperatures (above ambient) which are typically obtained by combustion of fuel gas. For a receiving terminal using seawater as the vaporization medium, the impact of added fuel-gas consumption can be significant. In this case, cost optimization may steer the process design toward reducing reboiler duties by lowering the column operating pressure, process heat integration, or by exploring other means to achieve gas interchangeability.

Conversely if a receiving terminal is designed to use combustion as the vaporization source, the impact of LPG extraction facilities on the fuel-gas consumption would be relatively minor. Therefore, the impact of adding LPG extraction facilities would be mainly on the capital spending, but not on fuel gas estimate (the fuel shifts from the vaporizer service to reboiler). There will be efficiency differences between submerged combustion vaporizer (SCV) and conventional furnaces to consider in the fuel gas estimate and economic evaluation.

Life-cycle cost analysis for cost optimization is done to capture the impacts of both one-time capital expenditure (CAPEX) and longer term operation expenditure (OPEX). In recent studies, increases in domestic natural gas cost have influenced the analysis results. Also, environmental regulations may also significantly affect the plant design. Of direct relevance to LPG extraction facilities would be the NOx emission limit from combustion burners.

One Step Pressurization Process: In one embodiment high-head LNG in-tank pumps could directly pressurize the LNG feeding into a LPG extraction column. The pressurized BOG can be directly fed to the lower part of the LPG extraction column. This process configuration can eliminate one step by direct pressurization from in-tank pumps, eliminate the BOG recondenser and directly feeds the pressurized BOG to the LPG extraction column, and reduces the heat input by feeding high temperature BOG to the LPG extraction column bottom. The high pressure BOG compression results in high power consumption (compared to typical low pressure BOG schemes) but it increases the BOG discharge temperature and thereby reduces the required heat input to the LPG extraction column reboiler. The biggest advantage of this process is the elimination of LNG boosting pumps and the BOG recondenser.

Some lean LNG, which meets pipeline specifications, can be sent out without processing. Continuous operation of a LPG extraction column is recommended in some embodiments regardless of the LNG feed composition. The LNG preheater/condenser allows the LPG extraction column overhead to be sub cooled without a residual compressor or a residual heater. The BOG can be mixed with feed LNG by passing from the bottom to the top. The LPG extraction column overhead can be re-routed to the BOG compressor suction.

When the heating value needs to be increased the same principle as injecting nitrogen can be used, but instead of injecting nitrogen heavier hydrocarbons, such as for example LPG can be injected. Injecting upstream of the recondenser can eliminate the need to pump LPG to a high pressure.

Power Integration

The receiving and regasification facilities can optionally be integrated with other industrial facilities, such as power plants or chemical plants, for example. Various methods have been applied to make productive use of the cold energy from LNG re-gasification, including cryogenic power generation, air separation, ethane/propane extraction, cryogenic crushing, solidification of carbon dioxide, deep freeze warehouse and storage, boil-off gas re-liquefaction, and seawater desalination. When designed and developed simultaneously as an integrated project many common facilities can be shared between the two plants. Examples of possible common facilities are seawater intake, seawater treatment, plant air, industry water, fire fighting and many others. The following are examples of different ways to integrate power plants to a receiving/regasification terminal.

Cold Energy Recovery

Figure 17:
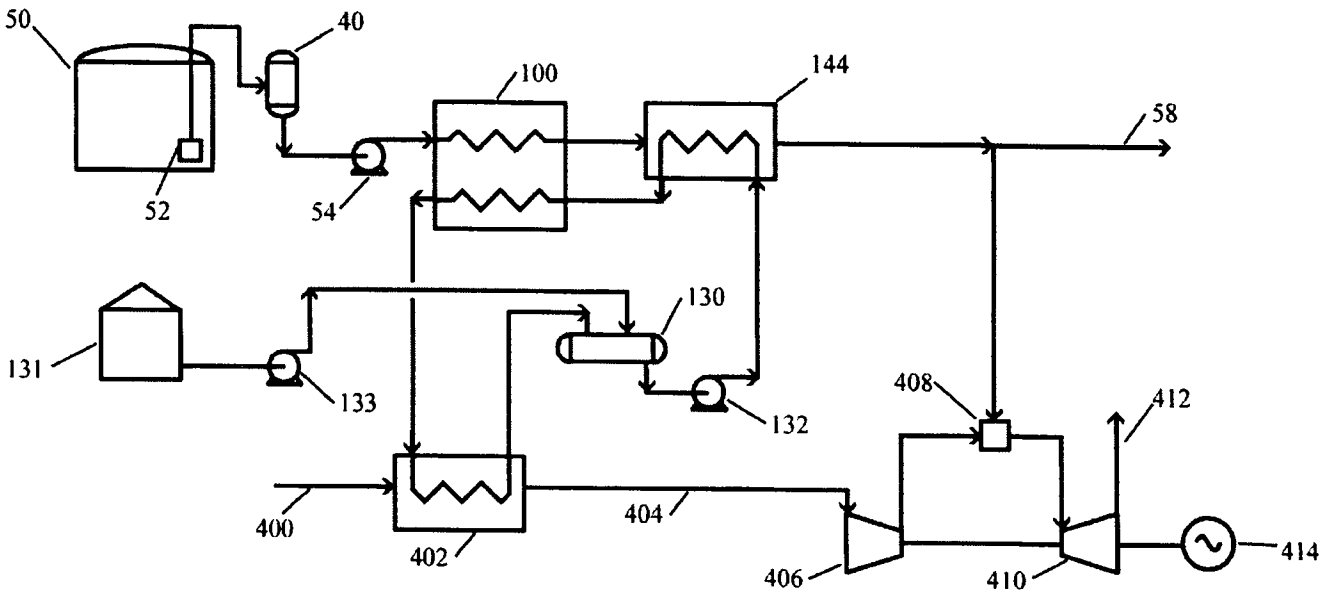
FIG. 17 depicts an illustrative schematic of electrical power generation using inlet air chilling for a turbine generator in conjunction with a LNG vaporization process.

Referring to FIG. 17, Gas Turbine (GT) inlet air chilling is a commercially proven method to generate more power from a fired turbine. Although the LNG can directly cool the GT inlet air, ice can form on the heat exchanger surface and a tube rupture is a possible result. To avoid the risk of ice formation, a heat transfer fluid loop is recommended, utilizing an applicable intermediate heat transfer fluid such as for example a water-ethylene glycol solution. In one embodiment, LNG can be pumped out of the storage tank 50 by the first stage pump 52, though an optional recondenser 40 and by the second stage pump 54 to the LNG vaporizer 100. At the LNG vaporizer 100, the intermediate fluid can be cooled while vaporizing the LNG. A trim heater 144 can be used to further heat the vaporized gas prior to delivery via line 58. The intermediate fluid that is cold from the LNG vaporizer 100 can then be heated while cooling the gas turbine inlet air 400 at an inlet air chiller 402. The HTF is then circulated through the HTF surge tank 130 and by HTF circulation pump 132. A HTF makeup tank 131 and pump 133 can be used to makeup any HTF losses. The moisture content of the air to be combusted in the GT must be considered when evaluating integration as it will have a direct affect on the heat duty of the GT inlet air chillers. As the moisture content of the air increases, the amount of cold energy recovered from the LNG increases due to the increased condensing load on the chiller. The chilled air 404 then proceeds to an air compressor 406, mixes with fuel gas 408 and is burned in the gas compressor 410. A hot exhaust stream 412 exits the turbine. The gas compressor 410 drives a generator 414 that produces electrical energy that can be utilized to provide power for the facility or for export.

For a Steam Condenser Circulation Water Cooling system, a wet cooling tower or once-through seawater system can be used to condense steam to keep vacuum expansion at a steam turbine. The cold energy from vaporizing LNG can also be used as a means to cool steam condenser circulation water. A lowered water temperature can result in lowered condensing pressure which can improve steam turbine power output. In case of a once-through type steam condenser at the combined cycle gas turbine, LNG cold energy can be used to reduce the necessity of adding additional pumps to mix the seawater heated through the condenser with unheated seawater in order to minimize the thermal pollution.

Figure 18:
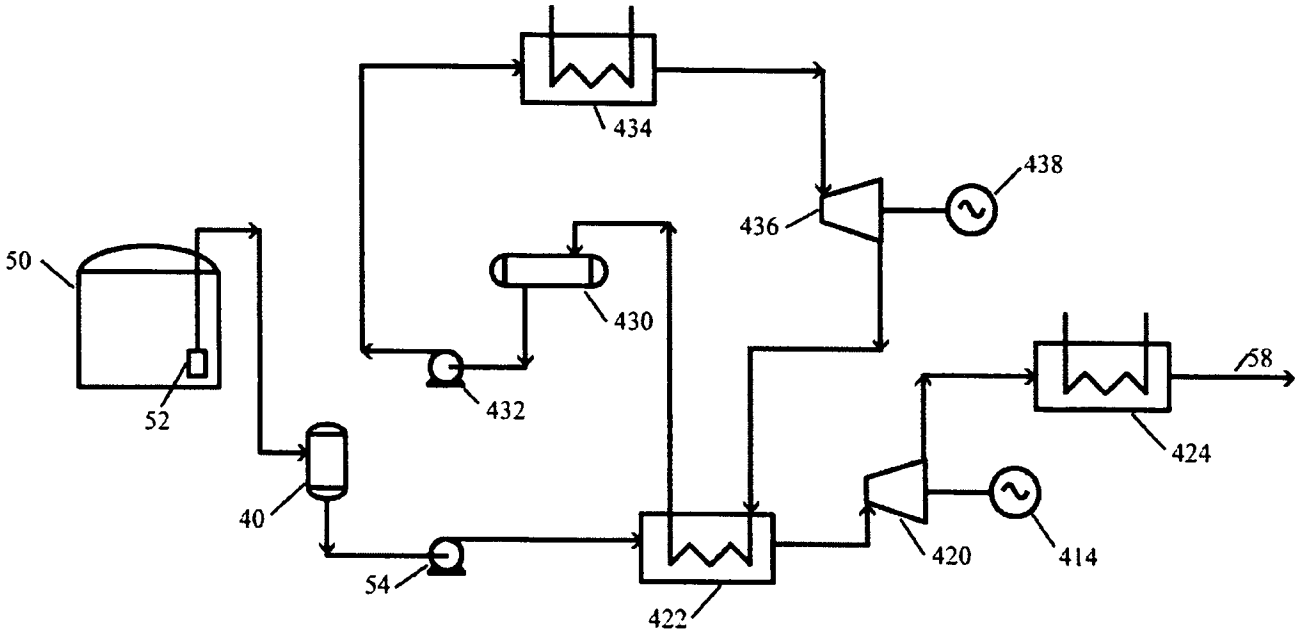
FIG. 18 depicts an illustrative schematic of electrical power generation by combined cycle direct expansion of LNG and a single fluid Rankin cycle.

Cold Power Generation is dependent on the gas send-out rate and pressure to which the vaporized LNG can be expanded. Referring to FIG. 18, direct expansion of the regasified LNG in an expander 420 combined with the expansion of single/multiple/mixed intermediate fluids using a Rankin Cycle, or a combination of both, can generate electrical power directly at the LNG receiving terminal. The LNG is vaporized in a LNG vaporizer/fluid condenser 422 and then sent to an expander 420 and an optional heater 424 before exiting as natural gas via line 58. The LNG expander 420 drives a generator 414 that can provide electrical energy for facility consumption or export. The Rankin Cycle comprises an intermediate fluid cycle having a surge tank 430, circulation pump 432, intermediate fluid vaporizer 434, intermediate fluid expander 436 and the LNG vaporizer/fluid condenser 422. The intermediate fluid expander 436 drives a generator 438 that can provide electrical energy for facility consumption or export.

Figure 19:
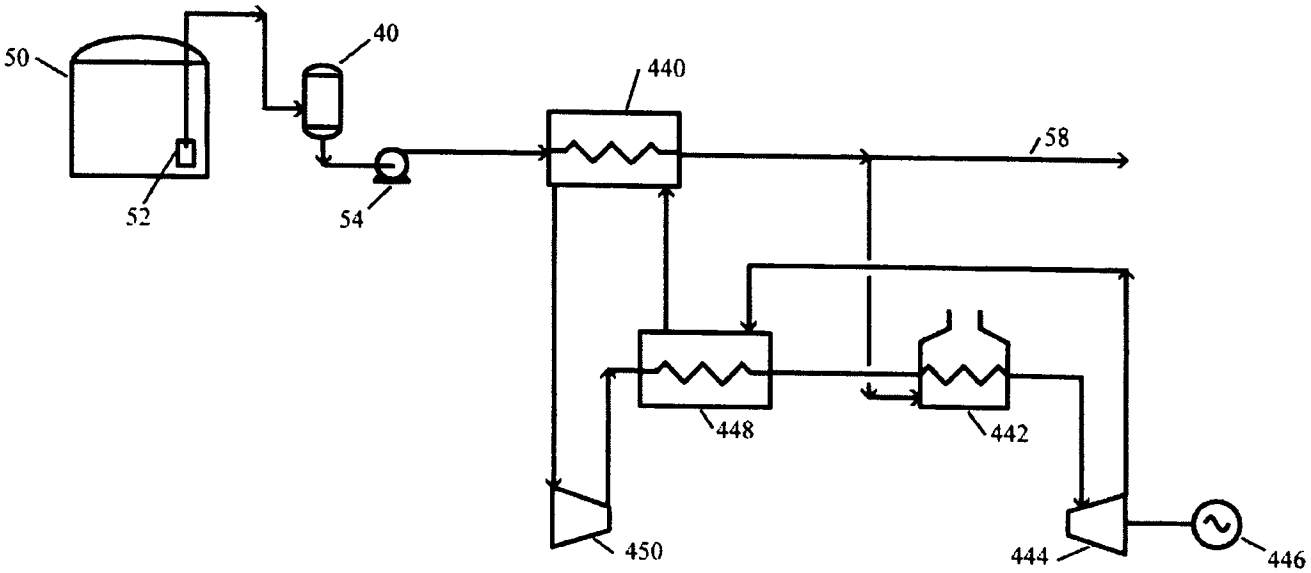
FIG. 19 depicts an illustrative schematic of electrical power generation with closed cycle gas turbine in conjunction with LNG vaporization.

Referring now to FIG. 19, the direct generation of electrical power can also be achieved by a cold enhanced combustion recovery system with gas export using a closed cycle gas turbine, open cycle gas turbine or a combination of both. LNG is vaporized in vaporizer 440. Part of the regasified LNG will be consumed in a fired heater 442 where the high pressure closed cycle gas is heated prior to passing through a gas turbine expander 444. The gas turbine expander 444 drives a generator 446 that can provide electrical energy for facility consumption or export. The low pressure gas from the expander can be cooled initially in an exchanger 448, sometimes referred to as a recuperator, against the flow of closed cycle gas to the fired heater 442 and then it vaporizes the LNG in the vaporizer 440. The cold cycle gas from the vaporizer 440 can be recompressed 450 and then reheated, first in the recuperator 448 and then in the fired heater 442. The expander turbine 444 can be used to drive both a compressor 450 and an electric generator 446. Air, nitrogen, or helium can be utilized as closed cycle gas.

Figure 20:
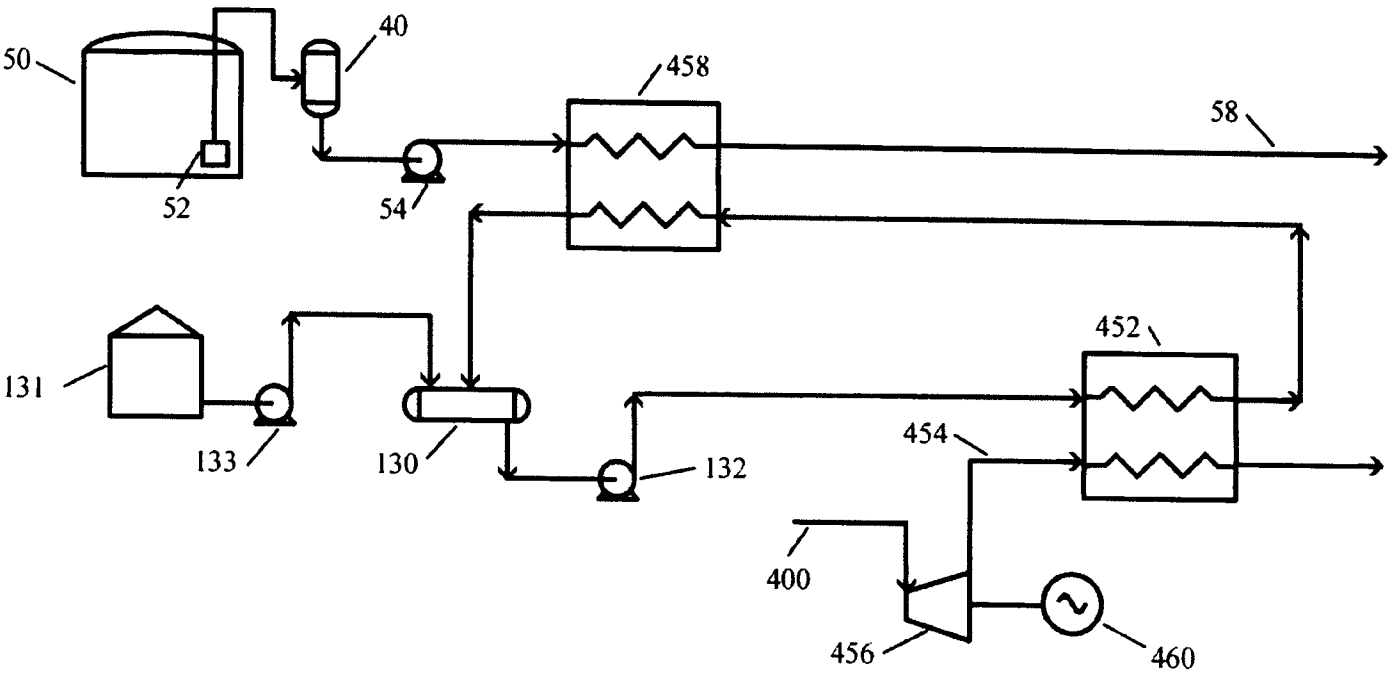
FIG. 20 depicts an illustrative schematic of a system for waste heat recovery from a power plant in conjunction with a LNG vaporization process.

Heat Recovery from a Power Plant:

Waste Heat Recovery: Heat can be recovered from a power plant and utilized within the LNG vaporization process, an example is shown in the schematic of FIG. 20. A HTF, such as a glycol/water mixture, can be circulated through a waste heat recovery unit where its temperature is raised through heat exchange 452 with hot turbine exhaust 454 from the gas turbine 456 of the power plant. The gas turbine 456 can be used to drive an electric generator 460. The HTF can then be integrated into a LNG vaporizer 458, such as for example providing auxiliary heat to a SCV or to warm the water used in a ORV prior to its contact with the vaporizing heat exchanger.

Once-Through Seawater: Seawater increases in temperature when used for steam condensing with a combined cycle gas turbine. The use of elevated temperature seawater for LNG re-gasification may reduce the total amount of seawater required. This type of thermal integration in some embodiments can share the seawater lift facility. The heat recovery from the power plant may also make ORVs practical at a cold seawater location.

Figure 21:
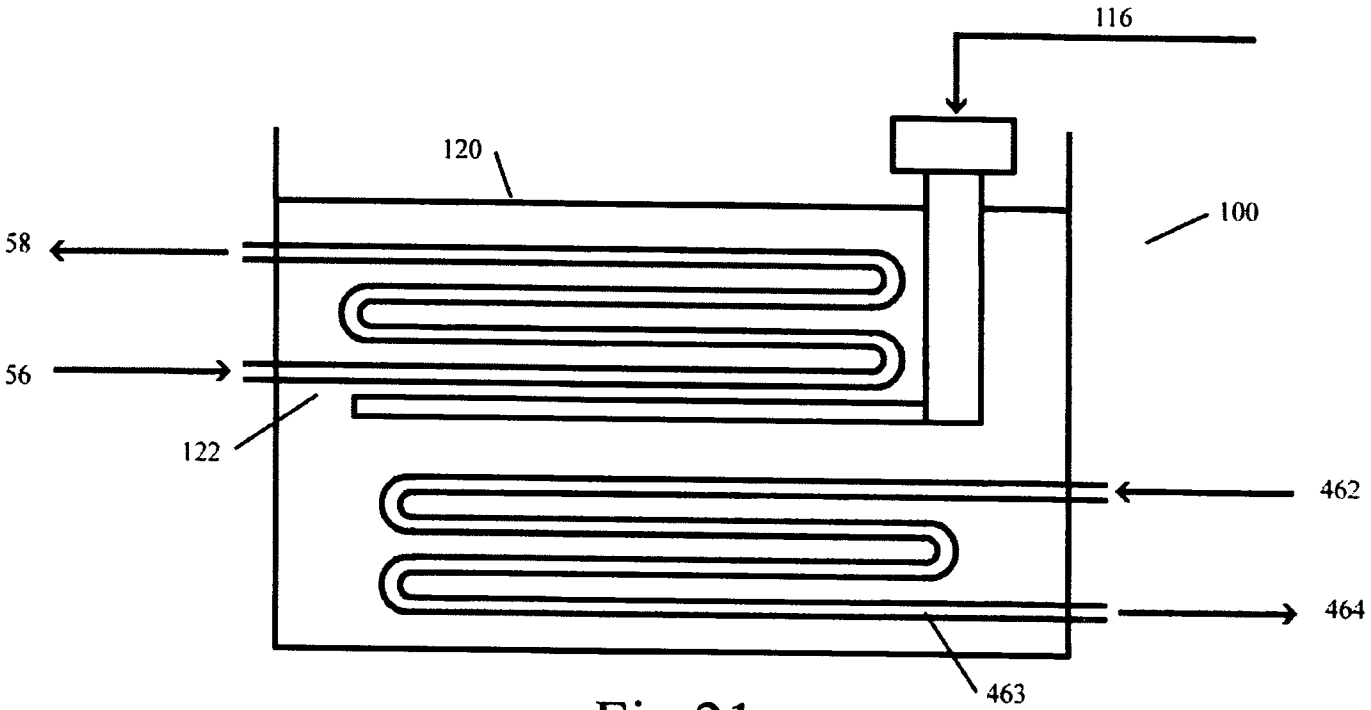
FIG. 21 depicts an illustrative schematic of a modified submerged combustion vaporizer utilizing heat recovery from a power plant.

Low Pressure Steam: Steam extracted from back pressure expansion can be used as a thermal energy source to vaporize LNG in a modified SCV as shown in FIG. 21, or in a separate heater. As with the typical submerged combustion vaporizer (SCV) shown in FIG. 11 a portion of the send-out gas is used as a fuel 116 for combustion that provides vaporizing heat and pass hot combustion gases into a water bath 120 that contains heating tubes 122 through which LNG passes in via line 56 and vaporized gas out via line 58. In the modified SCV back pressure expanded steam can enter the SCV via line 462, pass through heating tubes 463 and exit as condensate via line 464. After the low pressure steam is condensed in the modified SCV, the condensate can be returned to the power plant steam cycle.

Combination of Heat and Cold Energy Recovery:

The various integration options that are presented herein can be combined, for example the gas turbine inlet air chilling and low pressure steam extraction can be combined in one embodiment. Thermal energy can be extracted from the gas turbine inlet air reducing its temperature, thus increasing power output, while the low pressure steam can be utilized to vaporize LNG as described elsewhere herein. The combination of cold power generation with GT inlet air chilling is also an option. Pressurized LNG can be vaporized in an intermediate heat exchanger, where the operating fluid for the cold power generation is liquefied. The intermediate fluid can provide heat for LNG re-gasification after its utilization for chilling the GT inlet air. With this integration concept, both the intermediate fluid and operating fluid can be cooled while LNG is vaporized. The cold vaporized gas can in some cases be warmed up to the design point by low pressure steam.

Figure 36:
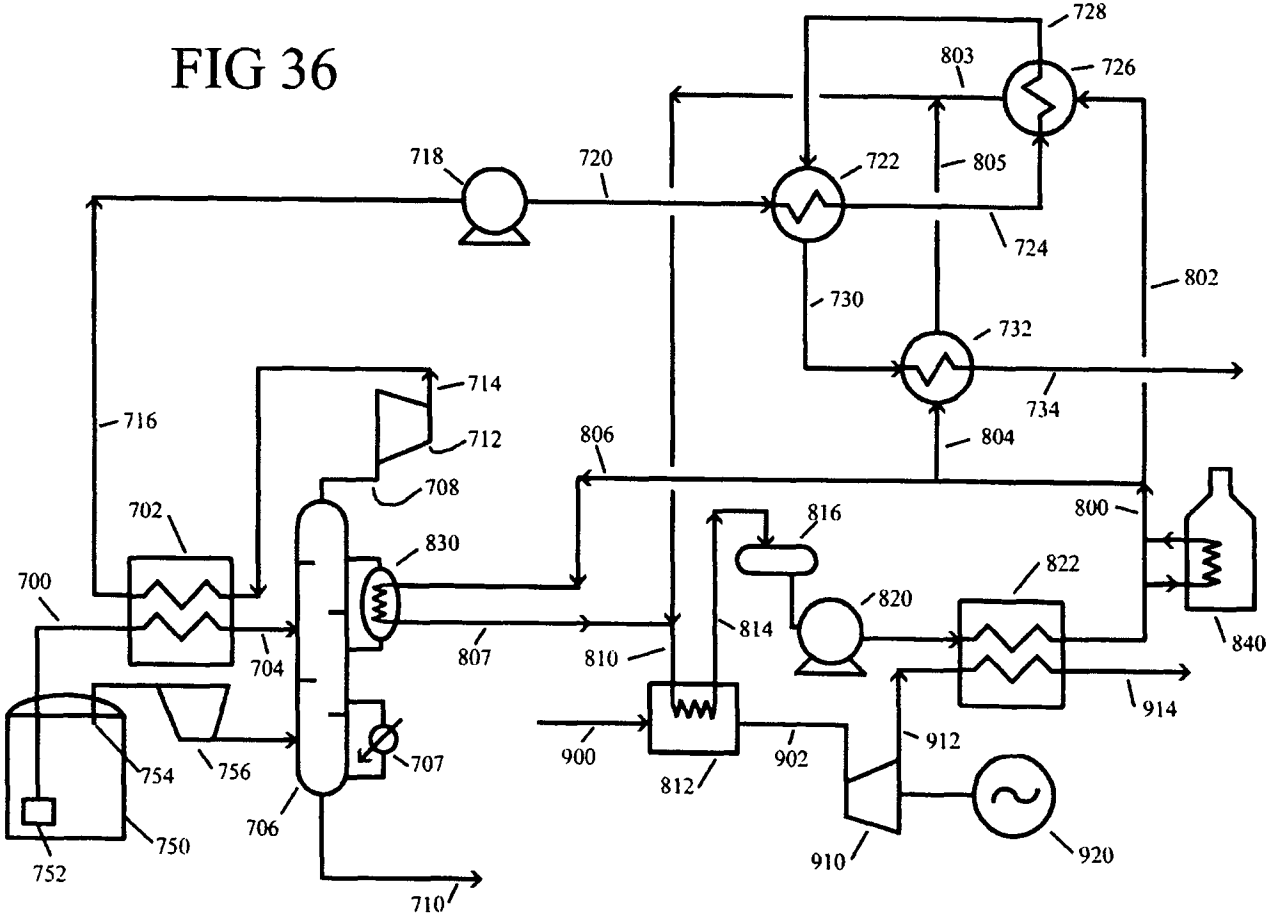
FIG. 36 depicts an illustrative schematic of an integrated system involving a modified residue compression and condensing scheme for extracting NGLs from a LNG stream, a three shell LNG vaporizer concept and a gas turbine having inlet air cooling and exhaust gas heat recovery.

Combination of Heat and Cold Energy Recovery and Power Generation:

Referring to FIG. 36, one illustrative embodiment of the present invention is an integrated method for vaporizing a liquefied natural gas stream, recovering natural gas liquids and generating electrical power. The method involves heating a first stream of liquefied natural gas 700 in a first heat exchanger 702 to produce a partially or fully vaporized natural gas stream 704. The stream is then fractionated in a distillation column 706 to produce a first vaporized natural gas stream 708 and a natural gas liquids stream 710 that can be recovered which can comprise ethane and higher (C2+) hydrocarbons or LPG. Operating conditions for the various parts of the overall system can vary based on the particular design of equipment used, throughputs, etc. and the overall system would typically be computer modeled to determine heating and cooling loads and the operating temperatures and pressures that would be the optimum. Operating temperatures and pressures would typically be within normal ranges known to those in the art and the scope of the present invention is not limited to specific parameter ranges.

The first vaporized natural gas stream 708 can be compressed 712 to increase the pressure by about 50 psig to about 250 psig to produce a first compressed gas stream 714 which is then condensed to a liquid state by heat exchange 702 with the first stream of liquefied natural gas 700 to produce a second stream of liquefied natural gas 716. In an alternate embodiment the first vaporized natural gas stream 708 can be compressed 712 to increase the pressure by about 50 psig to about 150 psig. The second stream of liquefied natural gas 716 is then pumped 718 to produce a first high-pressure liquefied natural gas stream 720 to a pressure from about 500 psig to about 1500 psig. An alternate embodiment the liquefied natural gas stream 720 can be pressured from about 800 psig to about 1200 psig.

The first high-pressure liquefied natural gas stream 720 is heated and at least partially vaporized by heat exchange in a second heat exchanger 722 with a third compressed natural gas stream 728 to produce a second compressed natural gas stream 724. The second compressed natural gas stream 724 is further heated in a third heat exchanger 726 by heat exchange with a first portion 802 of a first heat transfer fluid stream 800 to produce a third compressed natural gas stream 728. The third compressed natural gas stream 728 is then cooled in the second heat exchanger 722 by heat exchange with the first high-pressure liquid stream 720 to produce a fourth compressed natural gas stream 730. The fourth compressed natural gas stream 730 is then heated in a fourth heat exchanger 732 by heat exchange with a second portion 804 of a first heat transfer fluid stream 800 to produce a fifth compressed natural gas stream 734 suitable for delivery to a pipeline or for commercial use. A portion of the distillation column 706 can be heated in a inter-reboiler 830 with a third portion 806 of a first heat transfer fluid stream 800. The addition of a inter-reboiler 830 to the distillation column 706 can utilize the reclaimed heat energy from the gas turbine exhaust stream 912, can reduce the external heat load of the distillation column 706 provided by the conventional reboiler 707 and can assist in controlling the temperature profile within the distillation column 706, thereby increasing its efficiency. The inter-reboiler 830 can also be referred to as a side-reboiler or an inner-reboiler, all of which refer to an apparatus for providing heat duty to a column 706 at a location above a conventional reboiler 707. In some embodiments both the inter-reboiler 830 and the conventional reboiler 707 can receive heat duty from the heat transfer fluid. In an alternate embodiment there is only one conventional reboiler that receives heat duty from the heat transfer fluid. The heat transfer fluid from the distillation column reboiler can have a temperature of less than ambient and can then be utilized in a refrigeration capacity, a number of non-limiting examples of refrigeration uses are discussed herein. In one embodiment the heat transfer fluid exits the distillation column reboiler at a temperature less than about 25° C. In an alternate embodiment the heat transfer fluid exits the distillation column reboiler at a temperature less than about 20° C. In an alternate embodiment the heat transfer fluid exits the distillation column reboiler at a temperature less than about 15° C. In an alternate embodiment the heat transfer fluid exits the distillation column reboiler at a temperature less than about 10° C. In an alternate embodiment the heat transfer fluid exits the distillation column reboiler at a temperature less than about 5° C. In an alternate embodiment the heat transfer fluid exits the distillation column reboiler at a temperature less than about 0° C.

Still referring to FIG. 36, in one embodiment the first heat transfer fluid stream 800 is chilled by heat exchange with the second compressed natural gas stream 724 in the third heat exchanger 726, by heat exchange with the fourth compressed natural gas stream 730 in the fourth heat exchanger 732 and in the side reboiler 830 of the distillation column 706 to produce a second heat transfer stream 810. The heat transfer fluid outlet streams 803, 805, 807 from the heat exchangers and side reboiler can be combined to make up the second heat transfer stream 810. There are many possibilities for optimizing the heat transfer fluid system that will be apparent to a person skilled in the art. For example, the column inter-reboiler 830 may receive heat transfer fluid from downstream of the fourth exchanger (some or all of stream 805 from 732) or the third exchanger (some or all of stream 803 from 726) instead of only stream 806. The circulating heat transfer fluid can also provide some or all of the heat duty to reboiler 707.

A first air stream 900 can be cooled by heat exchange with the second heat transfer fluid stream 810 in a fifth heat exchanger 812 to produce a first chilled air stream 902 and a third heat transfer fluid stream 814. The first chilled air stream 902 can be an inlet air stream to a fired turbine 910. It is well known that power output of a fired turbine 910 can be substantially increased with colder inlet air temperatures. Therefore the output of the fired turbine 910 and the system efficiency as a whole can be improved with this integration concept. The fired turbine 910 produces an exhaust stream 912 and can drive a generator 920 that produces electrical energy. The heat transfer fluid stream can have a surge tank 816 and be circulated by pump 820 and is heated by heat exchange with the exhaust stream 912 of the turbine in a sixth heat exchanger 822 to produce the first heat transfer fluid stream 800. The efficiency of the system is improved with this integration concept that enables the capture and reuse of the thermal energy contained in the fired turbine 910 exhaust stream 912.

The first 800, second 810 and third 814 heat transfer fluid streams form a heat transfer fluid closed loop system. The first heat transfer fluid stream 800 is warmer than both the second 810 and third 814 heat transfer fluid streams, and the third heat transfer fluid stream 814 is warmer than the second heat transfer fluid stream 810. The first heat transfer fluid stream 800 can be separated into a first portion 802, second portion 804 and third portion 806 as required to provide heating duty to the third heat exchanger 726, the fourth heat exchanger 732 and the side reboiler 830 of the distillation column 706.

The second 722, third 726 and fourth 732 heat exchangers can be shell and tube type heat exchangers arranged in a three shell configuration that reduces the chances of freezing within the exchangers. The second heat exchanger 722 can have the first high-pressure liquefied natural gas stream 720 entering the tube side and the third compressed natural gas stream 728 entering the shell side; the third heat exchanger 726 can have the second compressed natural gas stream 724 entering the tube side and a portion 802 of a first heat transfer fluid stream 800 entering the shell side; and the fourth heat exchanger 732 can have the fourth compressed natural gas stream 730 entering the tube side and a portion 804 of a first heat transfer fluid stream 800 entering the shell side.

The first stream of liquefied natural gas 700 can be pumped from a LNG storage tank 750 to the first heat exchanger 702 and can be pumped using high head submersible pumps 752 located within the LNG storage tank. This can eliminate the need for a second stage transfer pump between the LNG storage tank 750 and the distillation column 706. Natural gas vapors from a top portion 754 of the LNG storage tank 752 can be collected, compressed 756 and supplied to the distillation column 706, which can eliminate the need for a recondenser in the system. An auxiliary heater 840 capable of increasing the temperature of the first heat transfer fluid stream 800 can be included. The auxiliary heater can be a fired heater.

Refrigeration Utilization of Cold Energy Recovery

Figure 22:
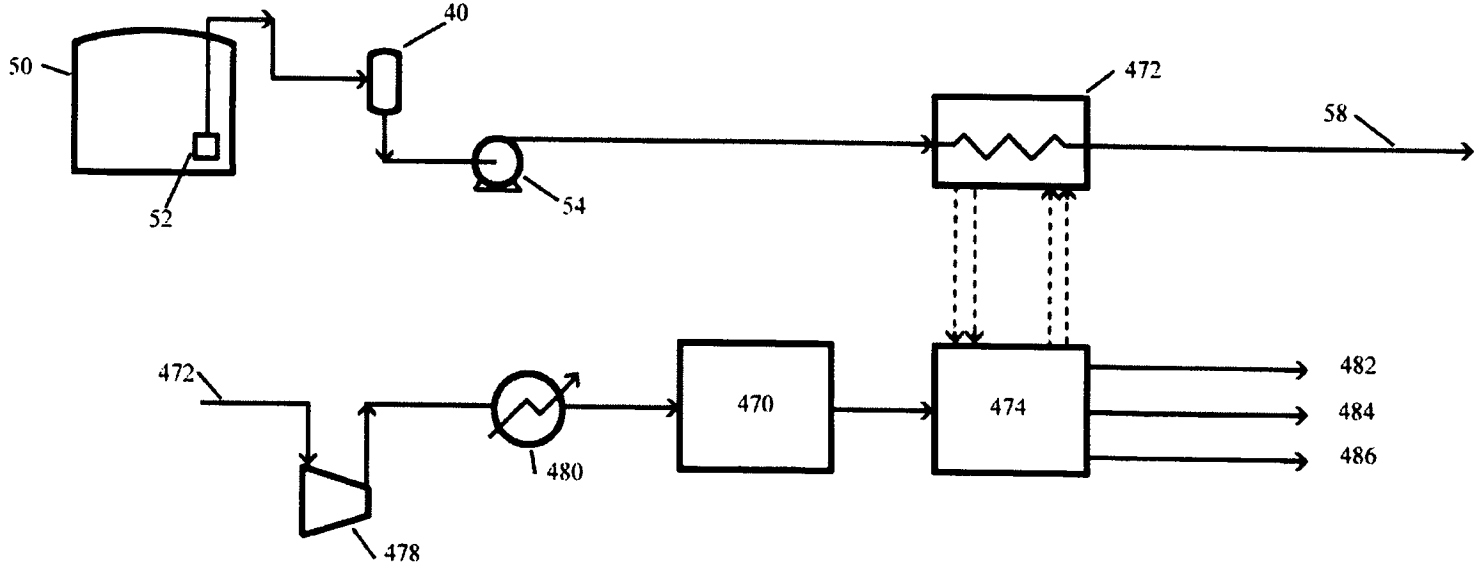
FIG. 22 depicts an illustrative schematic of an air separation and liquefaction plant utilizing cold energy from a LNG vaporization process.

Air Separation Unit: Referring to FIG. 22, an air separation unit (ASU) can be designed to separate nitrogen, oxygen and argon from air, normally operating at approximately minus 180° C., which is close to the temperature at which LNG vaporizes. Hence, combining LNG vaporization and air separation processes can provide an efficient integration to benefit both units. There are typically three sections within the air separation plant: air purification 470, air liquefaction 472 and air separation 474. The air liquefaction 472 is integrated with the LNG vaporization, providing the cold energy requirements. Air via line 476 is compressed 478 and cooled 480 prior to the air purification 470, air liquefaction 472 and air separation 474. After separation produced product streams of oxygen 482, argon 484 and nitrogen 486 are possible. The intermediate fluid, refrigerant and feed air can be chilled against LNG to assist in the production of liquid oxygen and nitrogen products. The ASU assisted by a LNG terminal provides a viable option for producing liquid products. This scheme can result in up to an approximate 50% reduction in power consumption and up to an approximate 30% reduction in operating cost compared to a conventional air separation plant.

Low Temperature Fractionation: The cold energy at temperatures down to negative 160° C. can be used as a source of refrigeration for low temperature separation and fractionation facilities and avoid or reduce the cost of providing and operating refrigeration plant facilities within the plant site. Typical plants could utilize this source of refrigeration may include facilities for the production of ammonia, chloro-carbons, ethylene and liquid petroleum gases (LPGs).

Cooling Process Waste Streams: Another application could be to use this cold supply to remove heat from process plant waste streams, such as reducing the temperatures of cooling water returns, which could reduce the environmental impact of these warm streams. This could be of particular importance in situations where high levels of heat are being discharged into relatively closed environments, e.g. harbors and estuaries, where there may be insufficient current to disperse them quickly.

Cold Storage and Deep Freezing: The cold energy at temperatures down to negative 160° C. could be used as a source of refrigeration for cold storage, freeze-drying, the manufacture of conventional or dry ice or deep freeze applications. One advantage of this application is that it offers a low noise use that can be conveniently located in a port and/or logistics center. Conventional cold storage or back-up refrigeration could be provided for short periods of time in the event the terminal is shut down. A related application could be the freezing of "eutectic plates" for use in refrigerated trucks.

Cryogenic Crushing: Cryogenic chilling of an elastic material normally transforms the structure into the brittle range enabling crushing. A large scale application could be the chilling and crushing of car tires to extract the metal and convert the rubber into a fine powder. Other potential applications include the crushing of volatile, toxic or explosive materials where cryogenic chilling will reduce the vapor pressure and the hazards. The chilling could be provided through the use of a suitable intermediate refrigerant.

Offshore Storage/Regasification Terminal

One embodiment has the location of storage and regasification equipment offshore due to environmental concerns, onshore siting and permitting issues, and a public perception of LNG as being a hazardous material. An offshore regasification terminal could involve an integration of offshore substructures, onshore regasification design and LNG transportation. Floating storage/regasification units (FSRU) and gravity-based structures (GBS) have been considered for offshore installation depending on the site conditions, such as depth of water, sub-sea soil, sea state, etc. A GBS may be more suitable for a near-shore application in shallow waters. Issues to be considered for the type of substructure to be used include motion, offloading requirements, proximity to shore and use of existing infrastructure. In one embodiment LNG can be stored in the hull of the vessel or structure with the regasification unit being located on the topside of the vessel or structure.

Hull Design: Steel and concrete hull options have been studied and can be purpose built to meet the site requirements and the execution strategy. A steel hull is a conventional design, provides greater flexibility and is generally perceived to be cheaper than concrete hull options. A concrete hull is heavy and rigid but does possess good cryogenic properties.

Side-by-side Transfer: The side-by-side system of offshore LNG offloading is where the LNG carrier is positioned along the length of a FSRU. This is similar in operation to conventional offloading at a jetty for a land-based terminal. The conventional LNG loading arms, with minimal modifications, can be utilized. Side-by-side transfer can be suitable for calm seas with low relative motion between the FSRU and the LNG carrier or in a sheltered environment that may be provided by a GBS.

Figure 23:
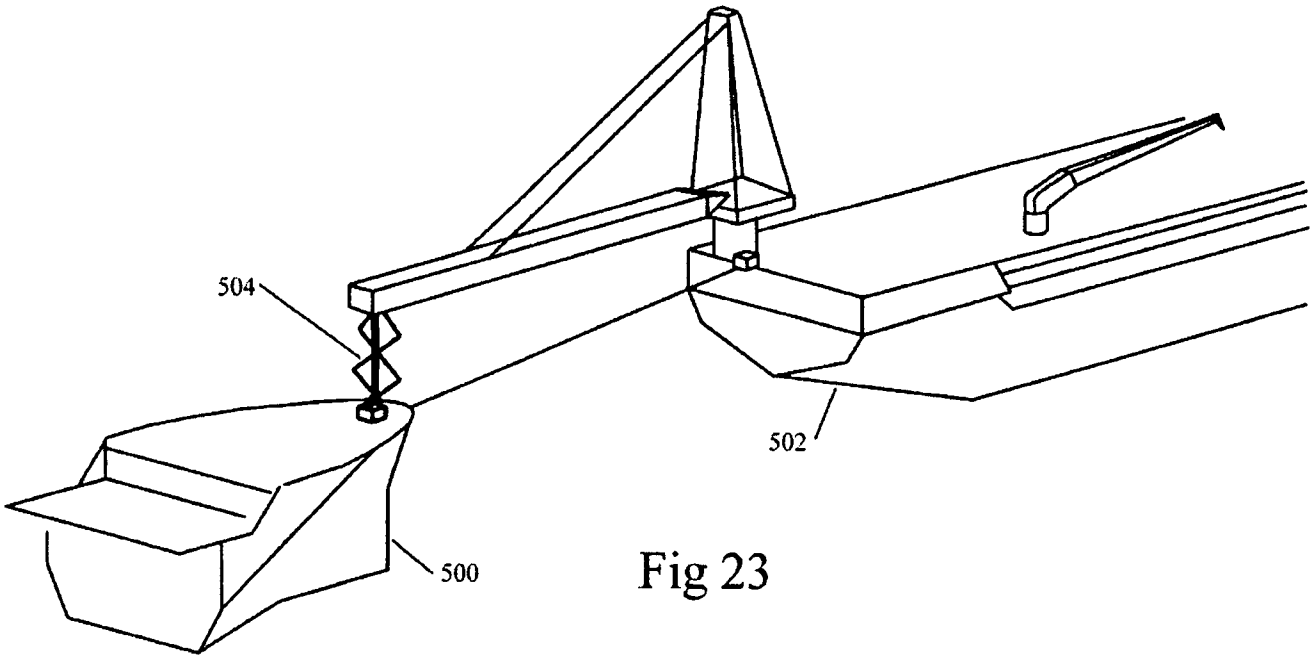
FIG. 23 depicts an illustrative schematic of a tandem LNG transfer system.

Tandem Transfer: Referring now to FIG. 23, a tandem transfer, also known as a boom-to-tanker system is where a LNG carrier 500 and a FSRU 502 are lined end to end. This system can be suitable for moderate to rough sea states that can cause high relative motion between the FSRU and the LNG carrier, and in one embodiment can utilize cryogenic swivels with rigid pipes and a double pantograph 504 arrangement. Single or multiple flexible cryogenic hoses can also be utilized.

The GBS is essentially motionless by the nature of its design. The effect of motion on a FSRU can be multidimensional in that it can affect equipment, structures and people. The degree of motion is influenced by hull dimensions and dynamics, sea states and the mooring systems that are utilized. FSRU design typically involves an intensive analysis to provide a sufficiently large range of motion for each component. An offshore regasification unit appears to be a viable option based on many design studies. All of the known critical technical issues have been analyzed and model tested and have not identified any insurmountable problems regarding an offshore regasification design.

Environmental Issues

Potential liquid effluent sources from terminals can include the following: Process wastewaters such as water blow-down from SCVs, leakage from heat transfer fluid, area wash down waters, cold seawater from ORVs, potentially contaminated storm water, sanitary wastewater and treated effluent. The seawater supply requires chlorination to protect the system, especially the heat transfer surface, against biological fouling. Chlorination is generally provided by means of injecting sodium hypochlorite solution (commercial bleach) into the suction of the seawater pumps, which can be on a continuous basis. An environmental assessment will typically be needed to plan for return water de-chlorination and aeration. When using seawater for cooling purposes, the World Bank Guidelines state that: "The effluent should result in a temperature increase of no more than three degrees Celsius at the edge of the zone where initial mixing and dilution take place. Where the zone is not defined, use 100 meters from the point of discharge." When providing heat for LNG vaporization the discharge seawater temperature decreases. Although the regulations for allowable seawater temperature change were initially developed for heating seawater, they are also applied to cold return water, since currently no regulations exist for discharging cooled water. The seawater discharge from an ORV is typically around ten degrees Fahrenheit cooler and can be blended into a large body of water, in order to keep average temperatures within the three degrees Celsius temperature difference at the boundary to satisfy the World Bank Guidelines.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for vaporizing a liquefied natural gas stream and recovering LPG therefrom comprising:

flowing a first stream of liquefied natural gas having a first temperature from a LNG storage tank to a first heat exchanger;

heating the first stream of liquefied natural gas in the first heat exchanger to a second temperature;

introducing the first stream of liquefied natural gas at about the second temperature to a LPG recovery column;

fractionating the first stream of liquefied natural gas at about the second temperature in the LPG recovery column to produce a first lean natural gas stream and LPG;

compressing natural gas vapors from the LNG storage tank to form a natural gas vapor stream;

introducing the natural gas vapor stream to the LPG recovery column at a location below where the first stream of liquefied natural gas at about the second temperature is introduced;

providing heat to the LPG recovery column with a first heat transfer fluid stream in a reboiler, wherein the first heat transfer fluid stream exits the reboiler as a second heat transfer fluid stream, the second heat transfer fluid stream having a temperature less than ambient temperature;

vaporizing at least a portion of the first lean natural gas stream in a second heat exchanger with a third lean natural gas stream to produce a second lean natural gas stream;

heating the second lean natural gas stream in a third heat exchanger with a first portion of a third heat transfer fluid stream to produce the third lean natural gas stream;

cooling the third lean natural gas stream in the second heat exchanger with the first lean natural gas stream to produce a fourth lean natural gas stream;

heating the fourth lean natural gas stream in a fourth heat exchanger with a second portion of the third heat transfer fluid stream to produce a fifth lean natural gas stream suitable for delivery to a pipeline or for commercial use; and cooling a first air stream by heat exchange with at least a portion of the second heat transfer fluid stream to produce a first chilled air stream and a fourth heat transfer fluid stream, wherein the first chilled air stream is an inlet air stream to a fired turbine.

2. The method of claim 1, further comprising heating at least a portion of the fourth heat transfer fluid stream by heat exchange with an exhaust stream of the fired turbine, wherein the fired turbine produces the exhaust stream.

3. The method of claim 1, wherein the fired turbine drives a generator that produces electrical energy.

4. The method of claim 1, wherein the LPG comprises ethane and heavier hydrocarbons.

5. The method of claim 1, wherein the heat transfer fluid streams are circulated by a heat transfer fluid circulation pump.

6. The method of claim 1, further comprising utilizing an auxiliary heater to increase the temperature of one or more of the heat transfer fluid streams.

7. The method of claim 1, wherein the first stream of liquefied natural gas is pumped from the LNG storage tank to the first heat exchanger.

8. The method of claim 7, wherein the first stream of liquefied natural gas is pumped using one or more high head submersible pumps located within the LNG storage tank.

9. The method of claim 7, wherein the natural gas vapor stream is introduced to the LPG recovery column at a location proximate a bottom end of the LPG recovery column.

10. The method of claim 9, wherein the natural gas vapor stream provides heat duty to the LPG recovery column.

11. The method of claim 10, wherein introducing the natural gas vapor stream to the LPG recovery column eliminates the need for a recondenser.

12. The method of claim 9, further comprising providing at least a portion of the first stream of liquefied natural gas as an input to a recondenser.

13. The method of claim 1, wherein the first stream of liquefied natural gas is heated in the first heat exchanger with the first lean natural gas stream from the LPG recovery column.

14. The method of claim 1, wherein the second portion of the third heat transfer fluid stream exiting the fourth heat exchanger is the first heat transfer fluid stream.

15. The method of claim 1, wherein the second, third and fourth heat exchangers are shell and tube type heat exchangers having a shell side and a tube side.

16. The method of claim 15, wherein the second heat exchanger has the first lean natural gas stream entering the tube side and the third lean natural gas stream entering the shell side.

17. The method of claim 15, wherein the third heat exchanger has the second lean natural gas stream entering the tube side and a portion of the third heat transfer fluid stream entering the shell side.

18. The method of claim 15, wherein the fourth heat exchanger has the fourth lean natural gas stream entering the tube side and a portion of the third heat transfer fluid stream entering the shell side.

19. The method of claim 2, wherein the third heat transfer fluid stream is heated with the exhaust stream of the turbine.

20. The method of claim 1, wherein the third heat transfer fluid stream is heated by an auxiliary heater.

21. The method of claim 1, further comprising:

compressing the first lean natural gas stream to produce a first compressed gas stream;

condensing the first compressed gas stream to a liquid state with the first stream of liquefied natural gas in the first heat exchanger to produce the first stream of liquefied natural gas at the second temperature and a first condensed gas stream;

pumping the first condensed gas stream to produce a first high-pressure lean natural gas stream; and vaporizing the first high-pressure lean natural gas stream in the second heat exchanger.

22. The method of claim 1, further comprising:

compressing the first lean natural gas stream to produce a first compressed gas stream; and vaporizing the first compressed gas stream in the second heat exchanger.

23. The method of claim 1, further comprising:

condensing the first lean natural gas stream to a liquid state with the first stream of liquefied natural gas in the first heat exchanger to produce the first stream of liquefied natural gas at the second temperature and a first condensed gas stream;

pumping the first condensed gas stream to produce a first high-pressure lean natural gas stream; and vaporizing the first high-pressure lean natural gas stream in the second heat exchanger.

24. The method of claim 1, wherein the first heat transfer fluid stream provides heat duty to the LPG recovery column in one or more of an inter-reboiler and a bottom reboiler.

25. The method of claim 1, wherein the second heat transfer fluid stream exiting the LPG recovery column has a temperature less than 25° C.

26. A method for vaporizing a liquefied natural gas stream and recovering LPG therefrom comprising:

flowing a first stream of liquefied natural gas having a first temperature from a LNG storage tank to a first heat exchanger;

heating the first stream of liquefied natural gas in the first heat exchanger to a second temperature;

introducing the first stream of liquefied natural gas at about the second temperature to a LPG recovery column;

fractionating the first stream of liquefied natural gas at about the second temperature in the LPG recovery column to produce a first lean natural gas stream and LPG;

recovering at least a portion of the LPG from the LPG recovery column;

compressing natural gas vapors from the LNG storage tank to form a natural gas vapor stream;

introducing the natural gas vapor stream to the LPG recovery column at a location below where the first stream of liquefied natural gas at about the second temperature is introduced;

providing heat duty to the LPG recovery column with a first heat transfer fluid stream in a reboiler, wherein the first heat transfer fluid stream exits the reboiler as a second heat transfer fluid stream, the second heat transfer fluid stream having a temperature less than ambient temperature;

cooling a first air stream with at least a portion of the second heat transfer fluid stream in one or more heat exchangers to produce a first chilled air stream and a third heat transfer fluid stream, wherein the first chilled air stream is inlet air stream to a fired turbine;

heating the first stream of liquefied natural gas in the first heat exchanger with the first lean natural gas stream from the LPG recovery column to at least partially vaporize the first stream of liquefied natural gas prior to the LPG recovery column;

vaporizing at least a portion of the first lean natural gas stream in a second heat exchanger with a third lean natural gas stream to produce a second lean natural gas stream;

heating the second lean natural gas stream in a third heat exchanger with a first portion of a fourth heat transfer fluid stream to produce the third lean natural gas stream;

cooling the third lean natural gas stream in the second heat exchanger with the first lean natural gas stream to produce a fourth lean natural gas stream; and heating the fourth lean natural gas stream in a fourth heat exchanger with a second portion of the fourth heat transfer fluid stream to produce a fifth lean natural gas stream suitable for delivery to a pipeline or for commercial use.

27. The method of claim 26, wherein the fourth heat transfer fluid stream is heated with an exhaust stream of the fired turbine in a heat exchanger.

28. A method for vaporizing a liquefied natural gas stream and recovering LPG therefrom comprising:

flowing a first stream of liquefied natural gas having a first temperature from a LNG storage tank to a first heat exchanger;

heating the first stream of liquefied natural gas in the first heat exchanger to a second temperature;

introducing the first stream of liquefied natural gas at about the second temperature to a LPG recovery column;

fractionating the first stream of liquefied natural gas at about the second temperature in the LPG recovery column to produce a first lean natural gas stream and LPG;

recovering at least a portion of the LPG from the LPG recovery column;

compressing natural gas vapors from the LNG storage tank to form a natural gas vapor stream;

introducing the natural gas vapor stream to the LPG recovery column at a location below where the first stream of liquefied natural gas at about the second temperature is introduced;

providing heat duty to the LPG recovery column with a first heat transfer fluid stream in a reboiler, wherein the first heat transfer fluid stream exits the reboiler as a second heat transfer fluid stream, the second heat transfer fluid stream having a temperature less than ambient temperature;

cooling a first air stream with at least a portion of the second heat transfer fluid stream in one or more heat exchangers to produce a first chilled air stream and a third heat transfer fluid stream, wherein the first chilled air stream is an inlet air stream to a fired turbine;

compressing the first lean natural gas stream;

condensing the compressed first lean natural gas stream to a liquid state with the first stream of liquefied natural gas in the first heat exchanger to at least partially vaporize the first stream of liquefied natural gas prior to the LPG recovery column;

vaporizing at least a portion of the condensed first lean natural gas stream in a second heat exchanger with the third lean natural gas stream to produce a second lean natural gas stream;

heating the second lean natural gas stream in a third heat exchanger with a first portion of a fourth heat transfer fluid stream to produce a third lean natural gas stream;

cooling the third lean natural gas stream in the second heat exchanger with the condensed first lean natural gas stream to produce a fourth lean natural gas stream;

heating the fourth lean natural gas stream in a fourth heat exchanger with a second portion of the fourth heat transfer fluid stream to produce a fifth lean natural gas stream suitable for delivery to a pipeline or for commercial use; and heating at least a portion of the third heat transfer fluid stream and at least a portion of the fourth heat transfer fluid stream with an exhaust stream of the fired turbine in a heat exchanger.

29. The method of claim 28, wherein the second heat exchanger is a shell and tube type heat exchanger having a shell side and a tube side wherein the first lean natural gas stream enters the tube side and the third lean natural gas stream enters the shell side.

* * * * *